US007200966B2

(12) United States Patent
Gooder

(10) Patent No.: US 7,200,966 B2
(45) Date of Patent: Apr. 10, 2007

(54) FIREARM STOCK

(75) Inventor: William Penty Gooder, 360 River Road, Hamilton (NZ)

(73) Assignee: William Penty Gooder

( * ) Notice: Subject to any disclaimer, the term of this patent is extended or adjusted under 35 U.S.C. 154(b) by 259 days.

(21) Appl. No.: 10/601,646

(22) Filed: Jun. 24, 2003

(65) Prior Publication Data

US 2005/0011101 A1 Jan. 20, 2005

(51) Int. Cl.
*F41C 23/14* (2006.01)

(52) U.S. Cl. ..... 42/71.01

(58) Field of Classification Search ..... 42/71.01, 42/72, 73

See application file for complete search history.

(56) References Cited

U.S. PATENT DOCUMENTS 1,084,848 A * 1/1914 Demele ..... 42/73
1,382,410 A * 6/1921 Butler ..... 89/40.06
1,569,901 A * 1/1926 Virdin ..... 42/72
2,627,132 A * 2/1953 Dolgacius ..... 42/118
2,826,848 A * 3/1958 Davies ..... 42/71.01
3,570,162 A * 3/1971 Suddarth ..... 42/72
3,618,584 A * 11/1971 Pigeon ..... 124/19
4,223,658 A * 9/1980 Sundstrom ..... 124/19
4,735,007 A * 4/1988 Gal ..... 42/72
4,878,305 A * 11/1989 Gabrielidis ..... 42/72
5,711,102 A * 1/1998 Plaster et al. ..... 42/71.01
5,778,588 A * 7/1998 Allen et al. ..... 42/71.02
5,903,995 A * 5/1999 Brubach ..... 42/94
5,924,233 A * 7/1999 Strobel ..... 42/72

* cited by examiner

*Primary Examiner*—Troy Chambers
(74) *Attorney, Agent, or Firm*—Sughrue Mion, PLLC

(57) ABSTRACT

A weapon stock, adapted to receive a firing assembly including a barrel and a receiver connected to the barrel. The stock has a first pistol grip interposed between a first forestock located towards a forward end and a butt stock located towards a rear end. In assembly with the firing assembly, the barrel is located adjacent to the first forestock towards the forward end. The stock further includes an elongated lower second forestock element spatially separated below the stock for at least part of its length at a location substantially at or below the first pistol grip and extending for a distance equal to or less than the distance between the barrel end distal to the receiver and the rear end of buttstock. The second forestock is attached to the stock at two or more attachment points wherein at one or more said attachment point(s) the second forestock is not integrally formed with said stock.

24 Claims, 35 Drawing Sheets

Figure 7
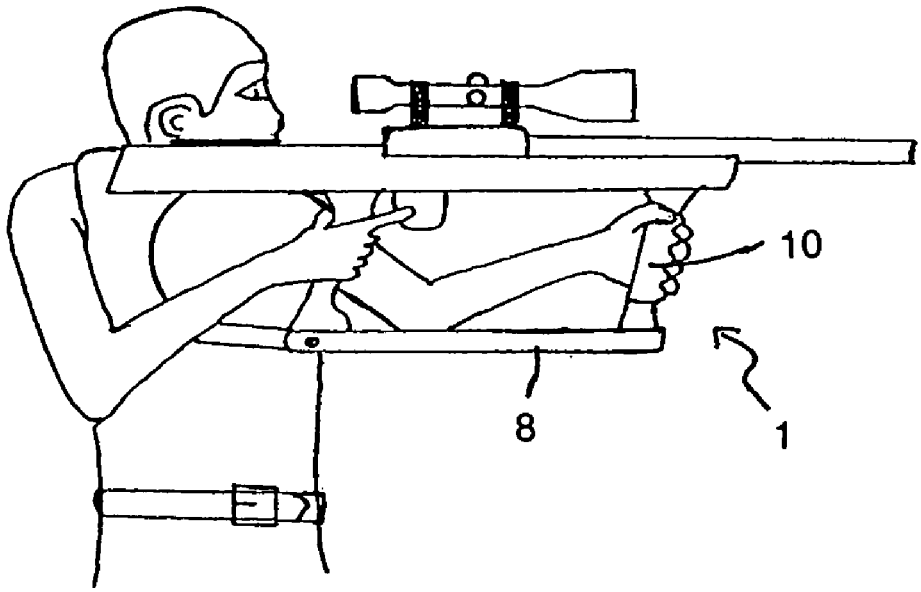
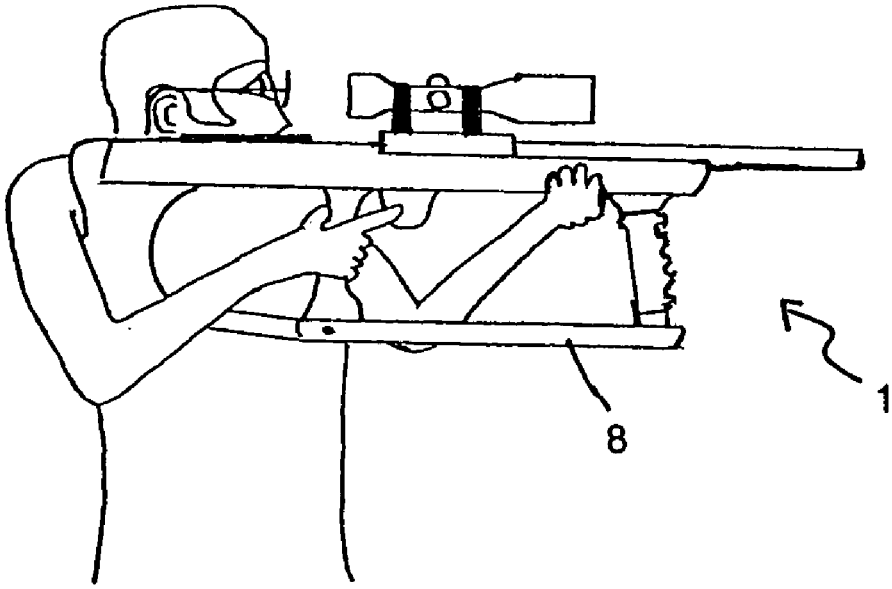
Figure 5

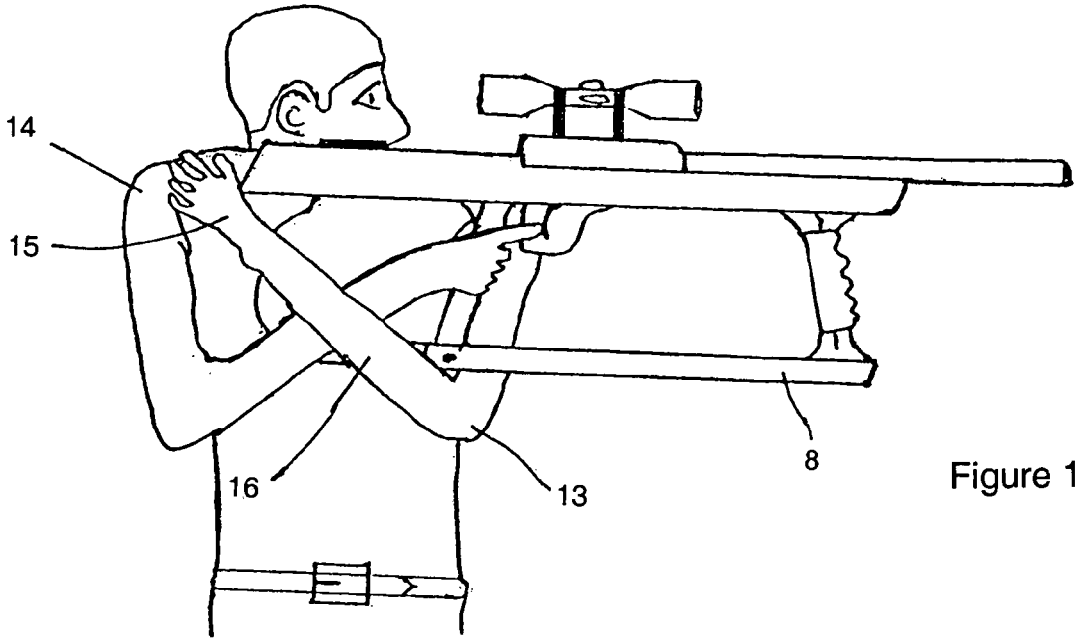
Figure 10
Figure 6
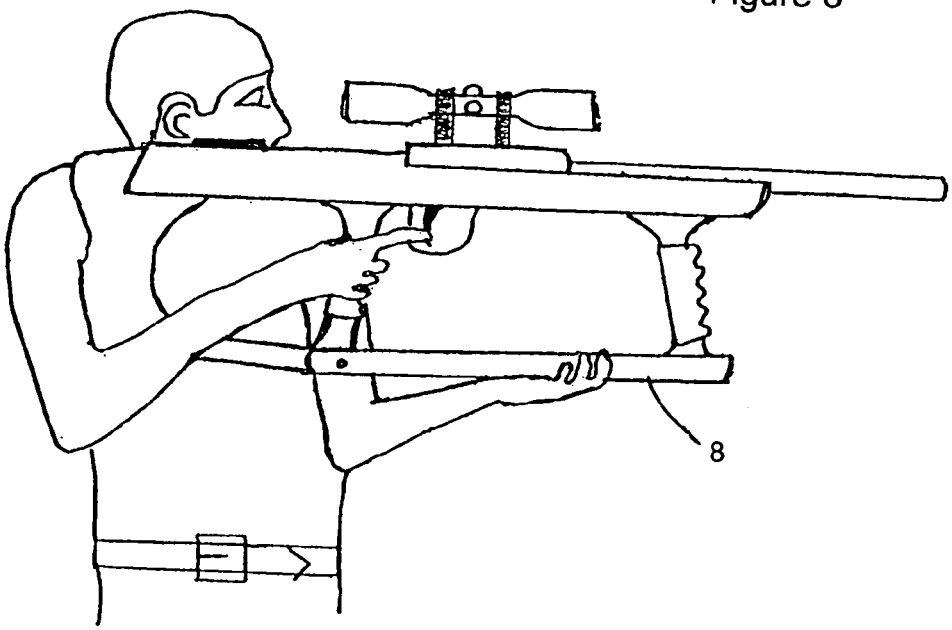

Figure 15
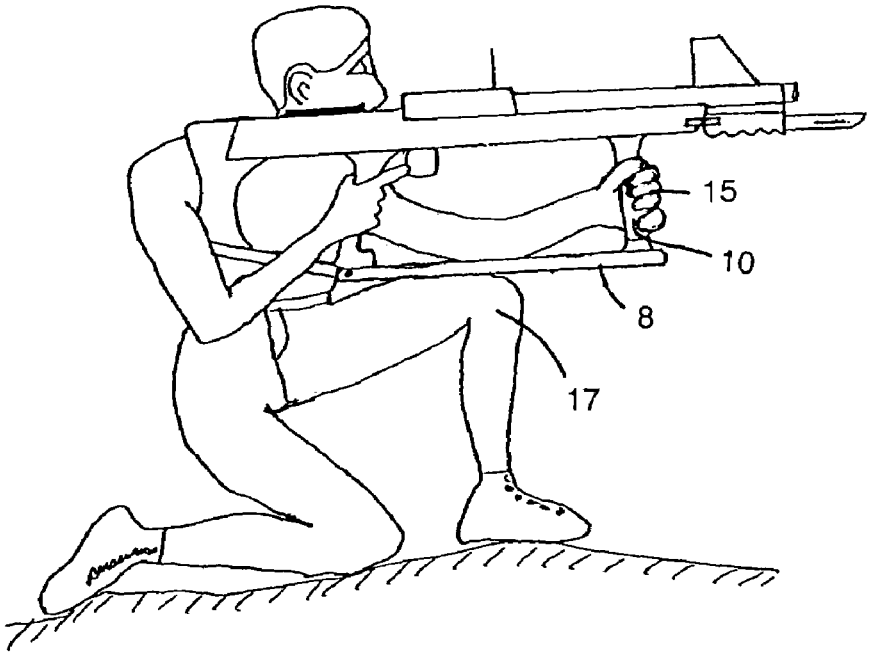
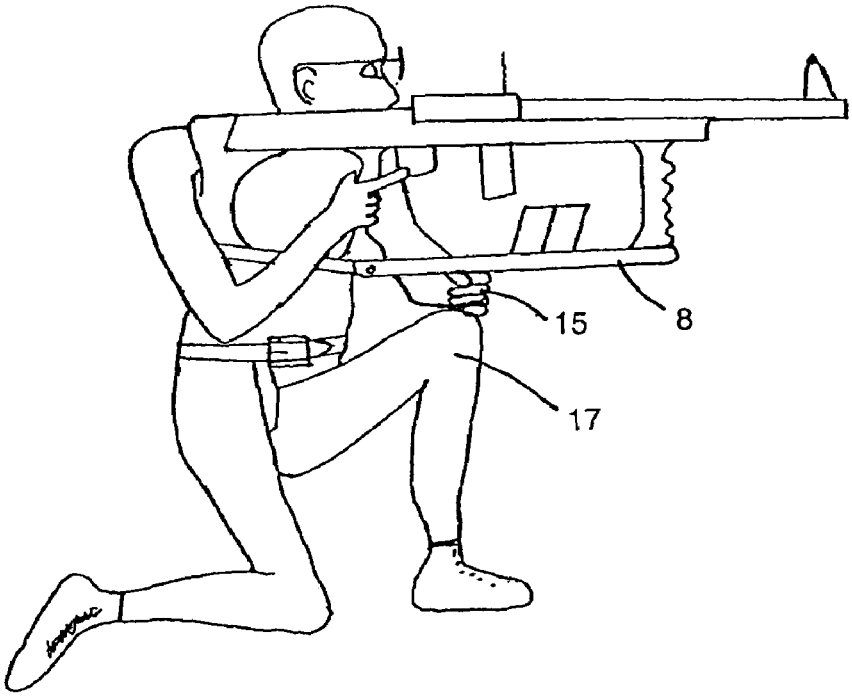
Figure 16

Figure 17
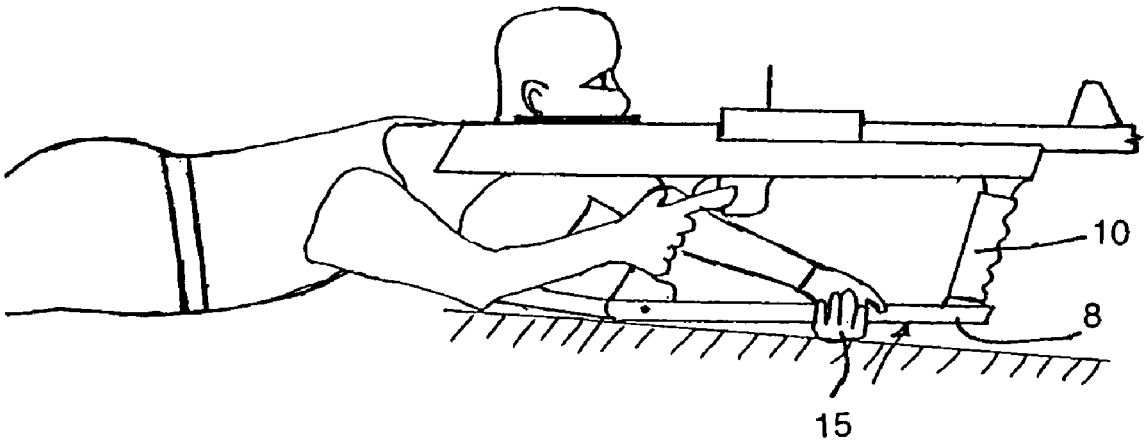
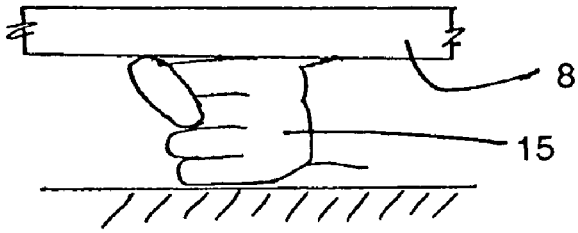
Figure 17a a) b)

b)

c)

FIREARM STOCK

TECHNICAL FIELD

The present invention relates to firearms generally, and in particular to rifle stocks and accessories thereto.

BACKGROUND ART

Despite the long history of firearms and the sustained research and development into improvements in both performance and ergonomics, the shape and configuration of a stock for a typical modern sporting rifle is comparable to that of similar weapons many decades earlier. Significant deviations from the archetypal rifle stock shape with a forestock, pistol grip, cheek piece and butt are rare in civilian/sporting weapons and uncommon even in military weapons.

Due in part to the conservative attitudes of shooters in adopting radical weapon developments and in part due to a perception that all possible advantages and refinements in stock ergonomics have been already explored, the focus of much weapon research and development has largely been confined to improvements in materials, propellants, reliability and ease of manufacture. This conservative attitude has also permeated development into the actual firing positions adopted by the shooter. Indeed, shooting technique instruction is often specifically restricted to the classic "positions" such as prone, sitting, kneeling and standing.

However, in these and other shooting positions, conventionally designed weapon stocks do not necessarily afford the shooter an ergonomic aid efficient means of supporting the weapon.

The use of rifles firing conventional ammunition is likely for the foreseeable future. The inherent characteristics of barrel length and weight of such rifles inevitably requires the shooter to support the weapon around the region of the forestock with one hands whilst operating the weapon trigger with the other hands. The support provided by the user's hand is supplemented and/or replaced in various situations by the use of rests, whether attached to the weapon itself, such as a bipod, or provided externally by a fence post and so forth.

The ergonomic shortcomings of typical rifle stock configurations have lead to various stock modifications and or attachments being employed in many target/sniper rifles. By definition, the performance criteria of paramount importance with a target/sniper rifle is that of accuracy. Therefore, in order to provided the greatest consistency between shots, the shooter must be able to maintain the most ergonomically efficient, comfortable and repeatable firing position.

Some target rifles employ adjustable hand grips in the forestock area with which the user supports the rifle with their non-trigger hand These attachments are often adjustable in the vertical and/or horizontal plane. They are however cumbersome and unwieldy for any sporting and/or military application. The ergonomic issues have also been partially, though not fully, addressed by the use of thumbhole stocks, adjustable cheek pieces/combs and adjustable butt plates.

Moreover, many shooters, both military and civilian, require or desire the use of weapon accessories for optional attachment to the weapon. These include items such as bipods, monopods, extra handgrips, sling swivels, weapon sights, spare magazines and so forth. Typical weapon stocks do not cater for efficient attachment of such accessories without compromise to the function or practicality of the weapon and/or accessory.

Therefore, there is a need for an adaptable, practical weapon stock capable of providing an enhanced ergonomic capability for the shooter in a variety of firing positions whilst being capable of enhancing the usability and/or effectiveness of various weapon accessories desired to be utilised by the shooter.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a weapon stock, adapted to receive a firing assembly including a barrel and a receiver connected to the barrel, said stock having a first pistol grip interposed between a first forestock located towards a forward end and a buttstock located towards a rear end, such that in assembly with said firing assembly, said barrel is located adjacent to said first forestock towards said forward end, said stock further includes an elongated lower second forestock element spatially separated below said stock for at least part of its length at a location substantially at or below the first pistol grip and extending for a distance equal to or less than the distance between the barrel end distal to said receiver and said rear end of said buttstock, said second forestock being attached to said stock at two or more attachment points wherein at one or more said attachment point(s) the second forestock is not integrally formed with said stock, characterised in that the second forestock lies in substantially the same plane as defined by the firing assembly, first forestock and first pistol grip, and extends below all pistol grips and operational features of the firing assembly:

It will be understood that references to the orientation of the invention and parts thereof throughout this specification are for explanatory purposes only and are made with reference to use of the invention held by an upright user in a conventional firing position, whereby parts of the invention adjacent the user are referred to as being towards the 'rear end' whilst those parts of the invention distal to the user are referred to as being in towards the 'front end'.

References to locations or positions of the invention and parts thereof in the vertical plane are made with respect to a user aiming a rifle incorporating the present invention in a conventional manner in the horizontal plane. However, the aforesaid references do not imply, restrict or confine the invention to use in a particular direction and/or orientation.

The term 'integrally formed' as used herein with reference to the attachment of the second forestock to the lower forestock is defined as including (but not limited to) a construction method wherein the parts are inseparable by conventional/intended use of the weapon; or without damaging the weapon stock, and/or including a continuous, unified, homogeneous, unbroken, non-segmented, non-hinged, unmovable, non-slidable, non-rotatable, non-detachable, non-releasable construction.

By configuring the stock with one or more non-integrally formed attachment points to the second lower forestock, numerous further features are possible, in addition to the improved shooting stances and weapon ergonomics outlined below. These further features include variants of existing weapon cycling mechanisms (e.g. pump action weapons)

improved stability aids (bipod attachment, side stands and so forth), cartridge/weapon accessory attachment and storage positions.

As used herein, the tern 'pistol grip' denotes any handgrip adapted or capable of being grasped by part or all of a user's hand.

The term 'weapon' and 'rifle' as used herein includes assault rifles, automatic and semi-automatic weapons, hunting and sporting weapons, personal defence weapons, sniper and target rifles, smooth bores and the like.

Reference to the shooter's free arm, free elbow, free hand and the like relate to those parts of the opposite arm to that used to pull the weapon trigger.

According to one aspect of the present invention, said second forestock extends in a substantially parallel orientation with said barrel. In alternative embodiments, said second forestock is inclined upwards or downwards towards said forward end.

According to yet a further aspect of the present invention, the portion of the second forestock between said first pistol grip and the rear end of said buttstock is inclined upwards or downwards towards said rear end.

The said second forestock may be attached to the stock in a variety of configurations, including attachment points at one or both of said first pistol grip and said first forestock.

The said second forestock attachment points may alternatively be located at said buttstock in combination with attachment to the first forestock and/or the first pistol grip.

According to a further aspect of the present invention, at least one said second forestock attachment point is attached to said first forestock by one or more bracing elements extending downwardly from the first forestock.

In one embodiment, said bracing element is a handgrip, preferably in the form of a second pistol grip.

The provision of the lower second forestock leads to multiple advantages particularly with regard to shooting positions, which are unavailable with known weapon stock configurations. Notwithstanding firing positions employing shooting rests of some form (monopods, bipods, tripods etc), almost all of the various firing positions utilise some form of auxiliary support of the weapon from the shooter's body. This usually involves using the shooter's non-trigger hand/arm, though a knee or even the shooter's torso may be used.

In a standing firing position, the configuration and dimensions of conventional rifle stocks prevents the user from readily holding the conventional (first) upper forestock whilst simultaneously using the torso as a support for the shooter's free elbow. This is primarily due to the underside of the conventional forestock being insufficiently separated from the barrel in the vertical plane to make use of elbow and torso support an ergonomic or practical possibility.

In a kneeling or sitting firing position, the aforesaid position of the first forestock lower surface also prevents practical use of the shooter's knees as a direct shooting rest.

These disadvantages are overcome by the provision of the lower second forestock at a position significantly lower than that of a first forestock The lower second forestock may be used as a direct support in a kneeling or sitting position and also used as the contact surface for the shooter's non-trigger free hand whilst resting the elbow of the free arm on the Hip/upper torso for further support.

The prone firing position also benefits from use of the lower second forestock as the free hand's fingers, palm and clenched or closed fist may be used to provide elevation adjustments as well as weapon support.

In addition to these and yet other positions possible using the present invention, the use of conventional firing positions, stances and weapon grips are not impeded.

It will be appreciated that an embodiment of the present invention with a continuous lower second forestock extending between the first pistol grip or buttstock and the forward end of the upper first forestock provides several practical advantages in providing a barrier to entanglement with undergrowth or other obstacles or hazards encountered during hunting or in military action.

However, the lower second forestock need not necessarily be continuous purely to provide weapon support during firing as described above.

Therefore, according to one embodiment, said lower second forestock is discontinuous at one or more points between said buttstock and/or said first pistol grip and the forward end of the first forestock towards the distal end of the barrel, whilst in an alternative embodiment, said lower second forestock extends continuously from said buttstock and/or first pistol grip towards the forward end of the first forestock.

Small arm weapons, particularly longarms such as rifles and the like are relatively bulky and heavy items of equipment which are often being carried for a prolonged period of time in comparison to that spent firing the weapon. Slings of various forms are a well known means for addressing these issues, invariably involving the use of flexible strips of material. These can potentially become tangled with the shooter and/or his equipment or the surroundings. Furthermore, the slings themselves and the associated sling swivels may break or require periodic maintenance/adjustment to function correctly.

According to a further embodiment said buttstock at least partly defines a first opening configured to accept insertion of a user's shoulder and to rest the weapon thereupon to provide a shoulder sling.

According to one embodiment of the present invention, said lower second forestock at least partly defines a second opening configured to accept insertion of a user's shoulder and to rest the weapon thereupon to provide a shoulder sling.

According to further aspects of the present invention, said attachment points of said second forestock to any of said buttstock, first pistol grip, second pistol grip, or first forestock may be by adjustable, releasable, pivotable and/or slidable fastening, or combination of same, in addition to fixed, or rigid attachment The above-described fastening means may be combined to provide a range of features, such as an adjustable angle bracing strut, particularly a second pistol grip. In such an embodiment, the second pistol grip may be pivotably hinged to the first forestock and slidably attached to the second forestock by means of an adjustable sliding configuration. Thus, the vertical angle of the second pistol grip may be varied by slidably moving the lower end of the second pistol grip to the desired position and then securing same by appropriate means, screw fastening, lugs and so forth.

It will be appreciated that the slidable attachment may take several forms such as a transverse pin/screw fastening, located in a slotted aperture in the lower second forestock. Alternatively, the second pistol grip may be pivotably hinged to a portion of the lower second forestock which is in turn telescopically attached to the remainder of the lower second forestock.

A variant of the use of telescopic and or slidable portions of the lower second forestock is to provide an extension to, or bridging of, one or more said discontinuities between portions of the lower second forestock. As an example, an opening configured to permit the use of elongated weapon magazines may be bridged by slidable/telescopic portion of the lower second forestock when shortened weapon magazines are being used.

According to a further aspect of the present invention, said lower second forestock and/or said buttstock includes one or more support elements rotatably attached to the lower surface of the lower second forestock and/or buttstock and capable of being rotated laterally outwards from the stock to support the stock in a substantially horizontal upright position when placed on a solid or semi-solid surface.

According to a yet further aspect of the present invention, said lower second forestock is releasably attached at a first end to said weapon stock, and pivotally attached to the weapon stock at a second end, such that the lower second forestock may be rotated downwards about said second end to act as a weapon support when placed on a firm surface or a support element worn by the user such as a belt or scabbard.

Automatic reloading actions are known for virtually all forms of small arms. Nevertheless, manually operated actions are still retained and even preferred in some weapons types such as pump-action weapons, e.g. shotguns, grenade launchers and the like. Such manually operated actions typically provide lighter, more reliable and less complex mechanisms than their automatic counterparts.

The use of the second lower forestock of the present invention enables yet further enhancement to reliability and performance. Typical pump action shotguns utilise a handgrip/slide to cycle the cartridge loading/ejection action. The requirement for some form of sliding attachment causes structural difficulties in using a forward pistol grip attachment as the handgrip slide. Any lateral or torsional forces applied to a pistol grip slide may cause a malfunction of, or damage to the pump mechanism. By the addition of the second lower forestock, the lateral stiffness of the pistol grip slide assembly is enhanced.

The pump action mechanism may be implemented in several configurations. The said second pistol grip attachment point to the second lower forestock is non-integrally attachment to said lower second forestock and/or said first forestock, wherein said non-integral attachment may be selected from the group including pivotal, slidable, rotatable, detachable and/or any combination of same.

An illustration of the capability and adaptability of the present invention may be shown by considering a stock with a second lower forestock with attachment points to the first pistol grip and to the upper first forestock by a second pistol grip. Such a stock can be seen to have three key attachment points, the first pistol grip base (FPGB), the second pistol grip base (SPGB) and the second pistol grip top (SPGT). Possible configurations of these attachment points include:

The SPGT may be formed as a i. fixed hinge; able to rotate (about a fixed pivot point) in the vertical plane parallel with the barrel. The angle of the pistol grip may thus be altered according to user preference by changing the angle of inclination.

ii. A detachable hinge; with the same properties as the fixed hinged above with the additional ability to easily remove the second pistol grip from the stock;

iii. sliding hinge, which may also be lockable and detachable and in addition to the properties of the detachable hinge, can also vary the reach of the second pistol grip from the firer;

iv. hinge pump (detachable or fixed), where the hinge attachment is fixed to a pump/slide fore stock configured to cycle the weapon load/eject action;

v. sliding pump hinge, with the combined properties of the hinge pump and sliding hinge described above;

It will be appreciated the sliding and/or rotating movement in the above connections may be limited in scope or prevented altogether by appropriate adjustment stops, screws, lugs and the like according to the particular needs of the user.

The SPGT may of course also be formed as a non-hinged, non-sliding attachment point, (either detachable or integrally formed) to a fixed or sliding pump-action first forestock.

Locking the sliding action of the pump action also provides an additional security means to prevent inadvertent or unauthorised use. Such a lock may be readily achieved in many various means including simply placing a padlock though an aperture on the pump slide rail of the second lower forestock.

Similarly, by way of an exemplary list of possible connections, the SPGB may be formed as a:

vi. integrally formed fixed connection;

vii. hinge, providing adjustment for variations in the inclination of the second pistol grip (in conjunction with a hinged or slidable SPGT, and as the fulcrum for scissor-action applications (e.g. wire-cutting) and rotating the second lower forestock when detached from any other attachment points (e.g. the first pistol grip) for use as a monopod or the like;

viii. detachable hinge, having the same properties as the hinge above with the additional ability to enable the lower second forestock to be rotated about a different attachment point for monopod use for example;

ix. a simple non-integrally formed attachment, dismantlable for storage though not field use;

x. hinge/series of apertures (also applicable at any attachment point including the SPGT), providing a plurality of location adjustments for reach and pistol grip inclination depending on the attachment configuration employed for the SPGT.

xi. arc slot, which offers the same configuration properties as the point x) without being limited to the specific location of the aperture series and can also ensure the angle of the second lower forestock does not change with adjustments to the second pistol grip, and xii. horizontal slot, which provides a further variant of the properties of x) and xi) above.

The above connection permits several pump-action configurations, including;

a conventional pull pump action, whereby the spent cartridge (if present) is ejected by pulling rearwards towards the firer and a new cartridge is chambered on the return forward stroke;

a push pump action, operating in the converse manner to the pull pump action, which can be used with underbarrel grenade launchers, fore-lever pump action, whereby the second pistol grip or other convenient bracing element rotates through an arc to cycle the (push or pull) pump action. This provides a hitherto unavailable pump action which utilises the user's wrist action rather than the linear action of the arm. The geometrical consequences of translating a rotational motion of the pistol grip into the linear motion of the pump-slide first forestock may only be accommodated by virtue of the above described attachment points (hinged, slotted, and so forth) of the present invention.

Finally, the FPGB connections for may be formed as a:

xiii. fixed, integrally or non-integrally formed (e.g. bolted) connection;

xiv. hinge, either fixed or detachable. As with the SPGT and SPGB, the hinge may be used in conjunction with a slot and/or a series of spaced apertures.

The (detachable) hinge enables the second lower forestock to be removed;

the second lower forestock to be used as a lever, shooting support, monopod, and the like;

adjustment of the second pistol grip inclination, and the fore-lever pump action (as described above).

Thus, it can be seen that the provision of a second lower forestock with at least one non-integrally formed attachment point to the stock provides numerous advantages as described above including detaching the lower forestock at either of the FPGB or SPOB and pivoting about the other to provide a monopod shooting support; or a lever arm action for wire cutting or the like. Furthermore, configuration of the whole stock enables the use of slinging/transport arrangements unavailable or impractical with conventional weapons including sling attachment points located at the four corners of the weapon. This configuration is stable and permits the stock to be carried in the manner of a backpack.

Due to the structural improvement afforded by the present invention to pump-action weapons, sling attachment may be provided on said first forestock without causing any structural malfunction of the pump mechanism.

It will also be apparent that existing rifle stocks may be adapted by the addition of a second lower forestock to provide the above-discussed advantages and facilities.

According to a further aspect, the present invention provides a method of adapting a weapon stock by the addition of a second lower forestock substantially as hereinbefore described.

Furthermore, the present invention also provides a second lower forestock as hereinbefore described capable of attachment to an existing weapon stock.

Thus, according to a further aspect, the present invention provides a first forestock sling attachment hoop extending at least partially over said barrel.

The lower second forestock also provides a convenient attachment position for equipment of various types. These are preferably mounted on the upper surface of the lower second forestock to obtain the protective benefits from same. However, such accessories/auxiliary devices may also be mounted alongside or below the lower second forestock if desired.

Thus, according to a further aspect of the present invention said lower second forestock is configured to accept one or more weapon accessories, wherein said weapon accessories include, but are not limited to, bipods, extra handgrips, weapon magazines, bayonets, wire-cutters, communication devices, computational devices, ammunition, speed-loaders, batteries, laser designators and so forth.

When long arms weapons such as rifles are left unattended, their irregular shapes present some difficulties with regard to avoiding potential damage and/or accumulation of unwanted dirt or foreign matter on or in the weapon. Such weapons may of course be stacked vertically upright, though without a purpose-made gun rack or other convenient or appropriate vertical support, this may not be a readily available alternative, particularly in the field.

Laying the weapon directly on the ground presents obvious potential difficulties in terms of dirt ingress to the weapon's operating mechanism and/or the sighting optics. Armoury and workshops are obviously equipped with vices and other holding devices to permit work to be carried out on a horizontally upright weapon. However, for many tasks, the time and effort involved in placing each weapon individually in a vice is disproportionably inconvenient in comparison to the work to be undertaken.

It will be appreciated that various kinks, curves, apertures or distortions may be incorporated into the lower second forestock to accommodate various operational, manufacturing, practical ergonomic or aesthetic requirements without departing from the scope of the invention.

BRIEF DESCRIPTION OF DRAWINGS

Further aspects of the present invention will become apparent from the ensuing description which is given by way of example only and with reference to the accompanying drawings in which:

FIG. 5. shows an embodiment shown in FIG. 1, being fired from a first standing position;

FIG. 6. shows an embodiment shown in FIG. 1, being fired from a second standing position;

FIG. 7. shows an embodiment shown in FIG. 1, being fired from a third standing position;

FIG. 10. shows an embodiment shown in FIG. 1, being fired from a sixth standing position;

FIG. 15. shows an embodiment shown in FIG. 1, being fired from a third kneeling position;

FIG. 16. shows an embodiment shown in FIG. 1, being fired from a fourth keeling position;

FIG. 17. shows an embodiment shown in FIG. 1, being fired from a first prone position;

BEST MODES FOR CARRYING OUT THE INVENTION

Figure 1:
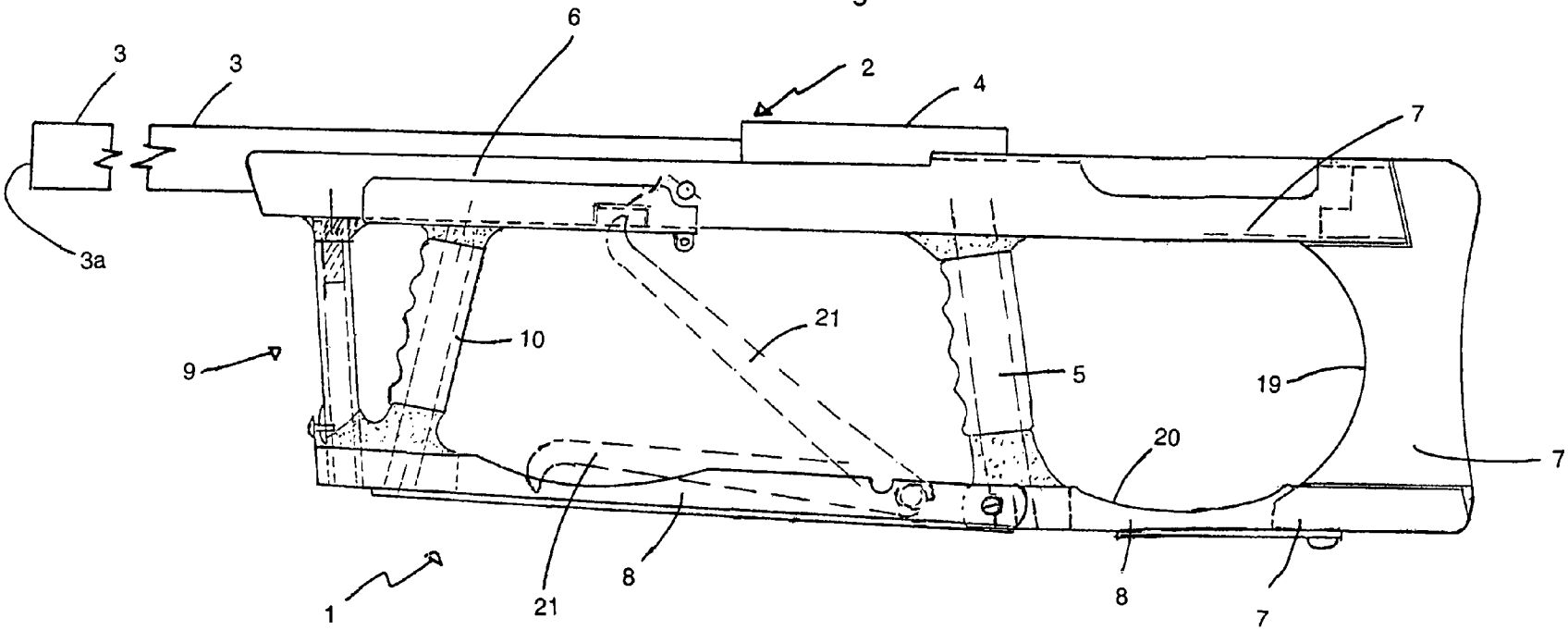
FIG. 1. shows a weapon stock in accordance with a preferred embodiment of the present invention.

Turning to the drawings, wherein like reference symbols indicate like parts common to all embodiments illustrated, FIG. 1 shows a preferred embodiment of present invention in the form of a weapon stock (1) adapted to receive a firing assembly (2) including a barrel (3) and the receiver (4) connected to the barrel (3). The firing assembly (2) may be of any known type of mechanism employed in rifles, and other long weapons including assault rifles, sniper rifles, target rifles, hunting and sporting rifles, automatic and semi-automatic weapons, shotguns and so forth.

The weapon stock (1) itself is composed of a first pistol grip (5) located between a first forestock (6) and a buttstock (7). The forestock (6) is located towards the forward end of the rifle adjacent to the barrel (3), when the weapon stock (1) is attached to the firing assembly (2). The buttstock (7) is located towards the rear end of the weapon and is adjacent to the user's shoulder during firing. The weapon stock (1) further comprises a second lower forestock (8) located substantially at or below the first pistol grip (5) and extending for a distance equal to or less than the distance between the distal end (3*a*) of the barrel (3) and the rear end of the buttstock (7).

In the embodiment shown in FIG. 1, the second forestock (8) extends in substantially parallel orientation with the barrel (3) though the invention is not necessarily restricted to such configuration. The lower forestock (8) may alternatively incline upwards or even downwards from the region of the first pistol grip (5) at an angle towards the forward end of the stock.

The lower second forestock (8) may be attached to the stock (1) in a variety of configurations. In FIG. 1, the lower second forestock (8) is attached at the lower end of said first pistol grip (5), at the buttstock (7) and at the forward end of the first forestock (6) by two bracing elements extending downwardly from the first forestock (6). At least one of the bracing elements is preferably configured as a hand grip (9) in the form of a second pistol grip (10). In alternative embodiments, a single bracing element (9), preferably in the form of a second pistol grip (10) may be employed.

Figure 2:
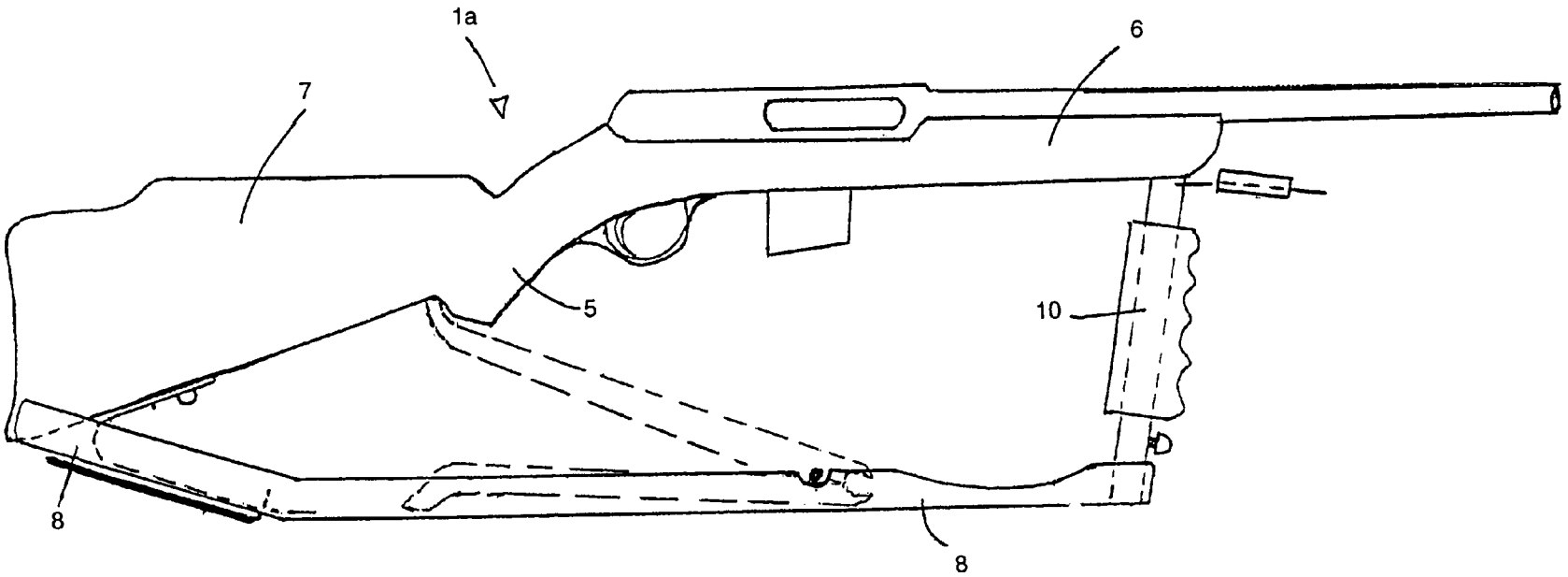
FIG. 2. shows an existing weapon stock modified in accordance with a further embodiment of the present invention.

The lower second lower forestock (8) and optionally one or more bracing elements (9)/pistol grip (10) may be formed as an integral part of the purpose-designed weapon stock (1), or alternatively, may be fitted to an existing weapon stock as shown in FIG. 2. The conventional rifle stock (1*a*) (shown in FIG. 2) is fitted with a second pistol grip (10) and a lower second forestock (8) extending from the second pistol grip (10) to the rear point of the buttstock (7), though it will be appreciated that the lower second forestock (8) could equally have been attached at the first pistol grip (5).

Figure 3:
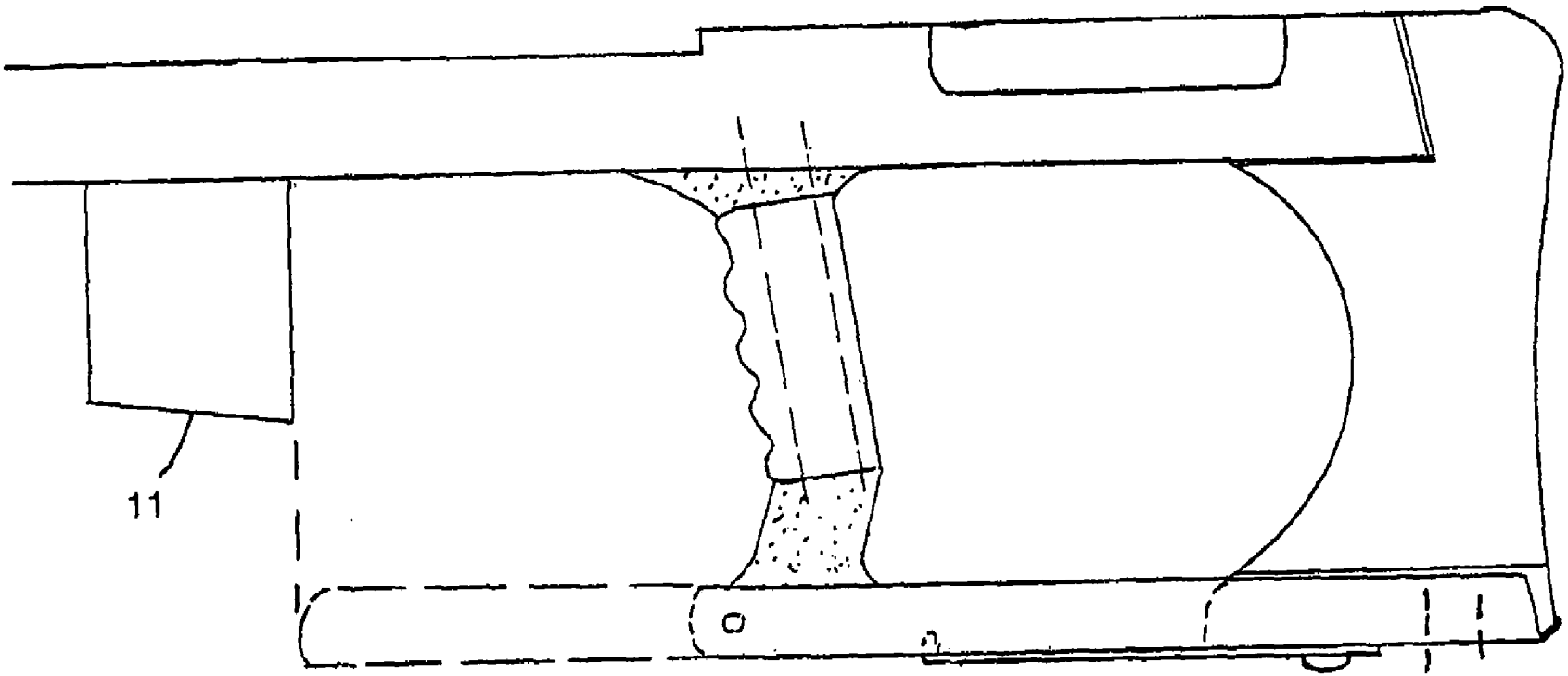
FIG. 3. shows a further embodiment of the present invention.

The lower second forestock (8) need not be necessarily continuous between the bracing element (9)/second pistol grip (10) and the first pistol grip (5) and/or the buttstock (7) in order to function correctly. FIG. 3 shows a discontinuity in the lower forestock (8) through which, for example, a weapon magazine (11) may be attached/detached to the weapon firing assembly (2). This discontinuity may be bridged (whether partially or completely) by a slidable, or telescopic portion (8*a*) of the lower second forestock (8), when shorter magazines (11) are being used.

Referring to the adaptation of the present invention to weapon magazines in particular, alternatives to the discontinuous lower second forestock shown in FIG. 3 are represented in the alternatives shown in FIG. 4*a*)–*c*).

FIG. 4*a*) shows in an underside plan view a linear elongated lower second forestock (8) (as shown in FIG. 1) which may be utilised in conjunction with relatively short weapon magazines (11).

FIG. 4*b*) shows a laterally kinked lower second forestock (8) enabling longer weapon magazines (11) to pass vertically downwards past the lower second forestock (8), while also permitting easier insertion of medium or short weapon magazines (11) into the firing assembly (2). The lower second forestock (8) may be kinked to the left or right side (in plan view) dependant on use by a left or right handed shooter and their preferred hand used to change the magazine (11).

Figure 4:
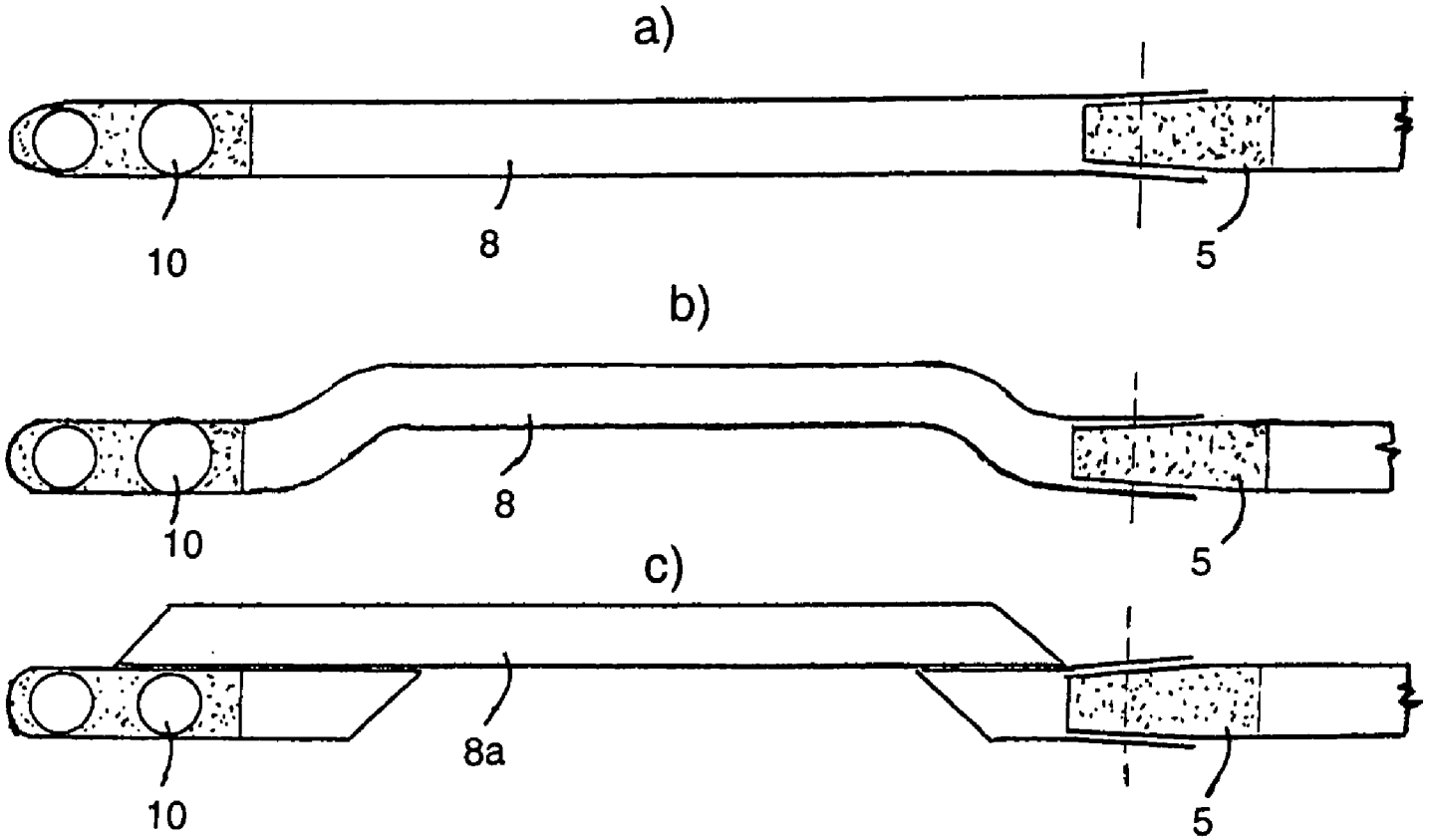
FIG. 4. *a*)–*c*) shows alterative plan views from below of various lower forestocks.

FIG. 4*c*) shows a variant of that shown in FIG. 4(*b*) whereby a supplementary elongated element (8*a*) is used to form the laterally kinked shape of the lower second forestock (8).

The use of the lower second forestock (8) provides additional shooting positions unavailable with conventional weapon stock configurations. Reference will be made to standing, kneeling, sitting and prone firing positions, though it should be appreciated that these are for exemplary purposes and that the invention is not necessarily limited to use in these positions.

Firing conventional rifles from a standing position normally requires the shooter to place their free (i.e. non-trigger) hand on the conventional first forestock (6) to support the weapon during aiming and firing. This firing position (shown in FIG. 5) may still be adopted with the stock (1) of the present invention.

However, alternative standing firing positions are possible by use of the present invention. FIG. 6 shows a user holding the underside of the lower second forestock (8) with their free hand whilst simultaneously resting the elbow of the free arm on the hip/upper torso of the shooter to provide additional stability and stamina.

Figure 9:
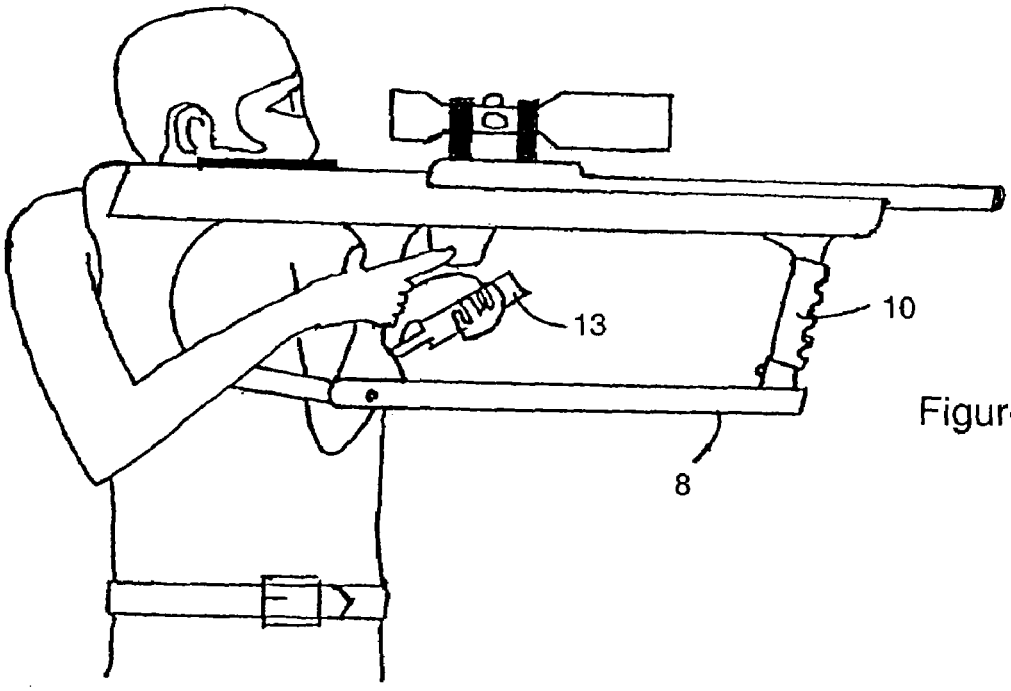
FIG. 9. shows an embodiment shown in FIG. 1, being fired from a fifth standing position.
Figure 8:
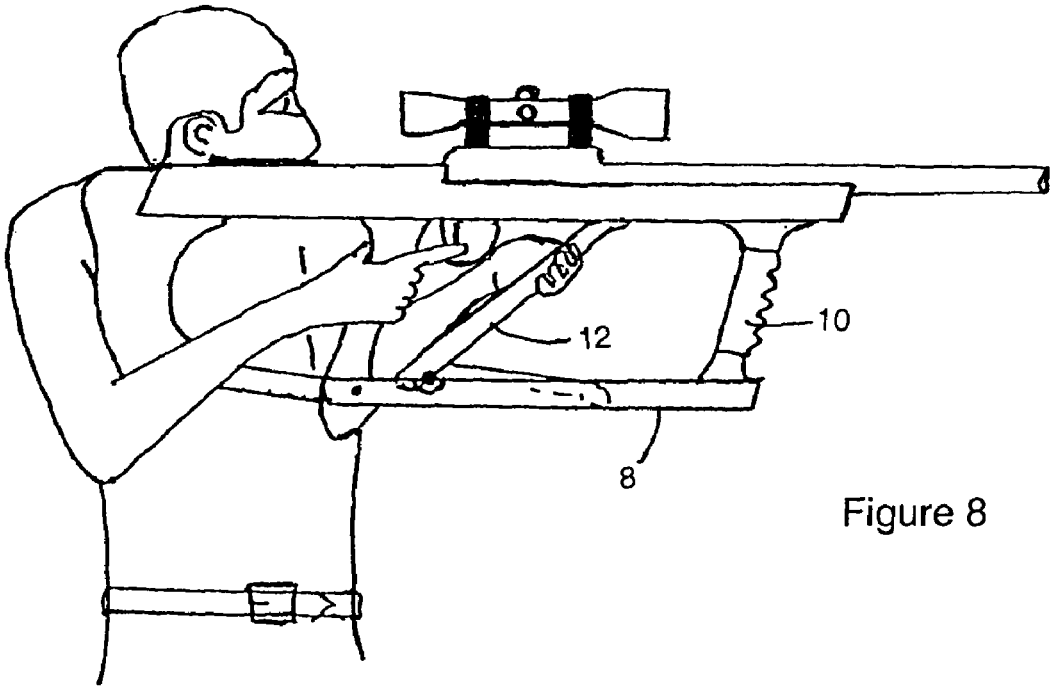
FIG. 8. shows an embodiment shown in FIG. 1, being fired from a fourth standing position.

Variants of the standing position include holding the second pistol grip (10) (or any other convenient bracing element (9)) with the shooter's free hand as shown in FIG. 7. Alternatively, the shooter may grasp alternative handholds present such as a the leg of a bipod (12) attached to the stock (2) or a purpose designed hand grip (10*a*) attached to the first pistol grip (5), as shown in FIG. 8 and FIG. 9 respectively.

The present invention also enables the use of a hitherto unused firing position in which the shooter rests the lower second forestock (8) in the crook of the free arm elbow (13) and using the hand (15) of the free arm (16) to hold the weapon or shooters clothing at the opposing shoulder (14). The resultant firing position resembles a 'hug' and may also be employed in the sitting and kneeling positions as shown in FIGS. 11 and 12 respectively.

Referring specifically to shooting from the sitting position, the present invention also provides additional benefits in terms of weapon aiming and firing support. FIG. 11 shows the use of the 'hug' firing position described above with reference to FIG. 10, with the exception that the lower second forestock (8) is rested on the shooter's leading knee (17), i.e., the knee closest to the forward end of the barrel (3). Alternatively, either one or both knees (17, 18) may be used for support of either one or both of the shooter's elbows (13) and/or the leading knee placed directly in contact with the lower second forestock (8).

Figure 11:
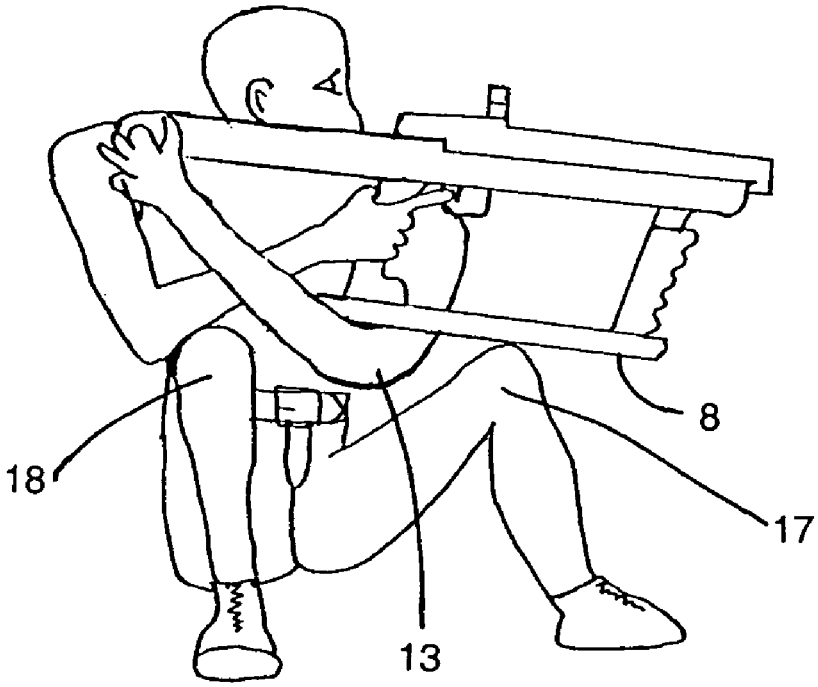
FIG. 11. shows an embodiment shown in FIG. 1, being fired from a first sitting position.
Figure 12:
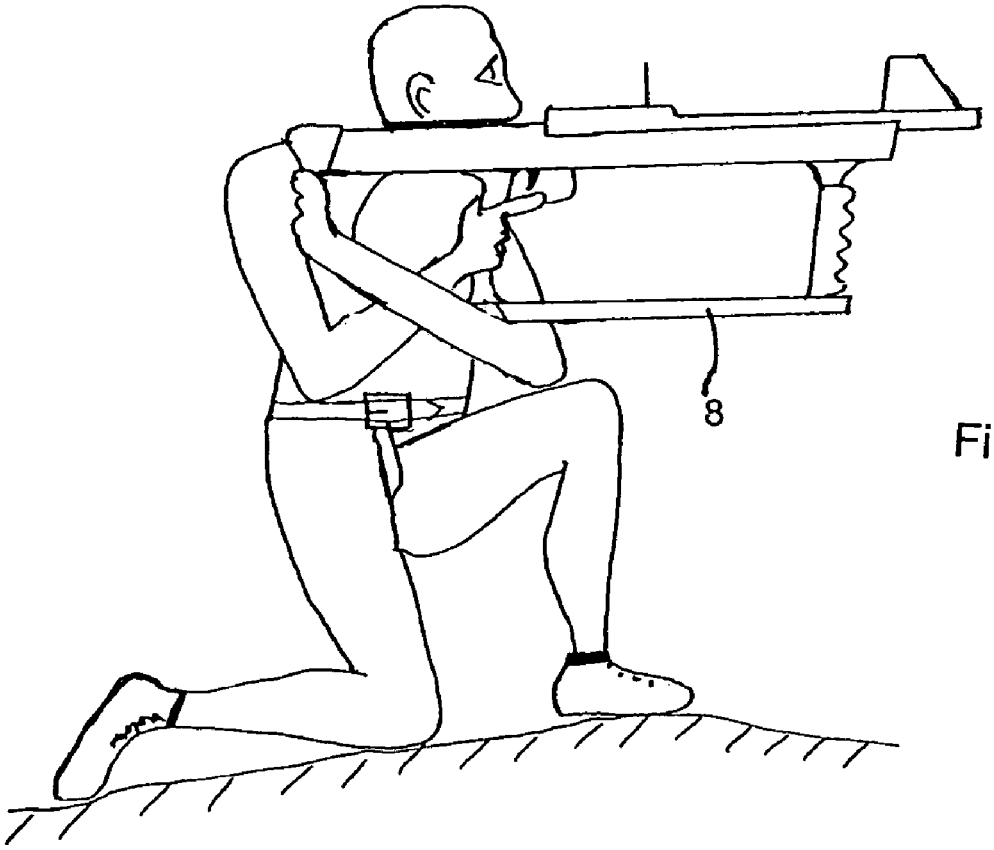
FIG. 12. shows an embodiment shown in FIG. 1, being fired from a first kneeling position.
Figure 13:
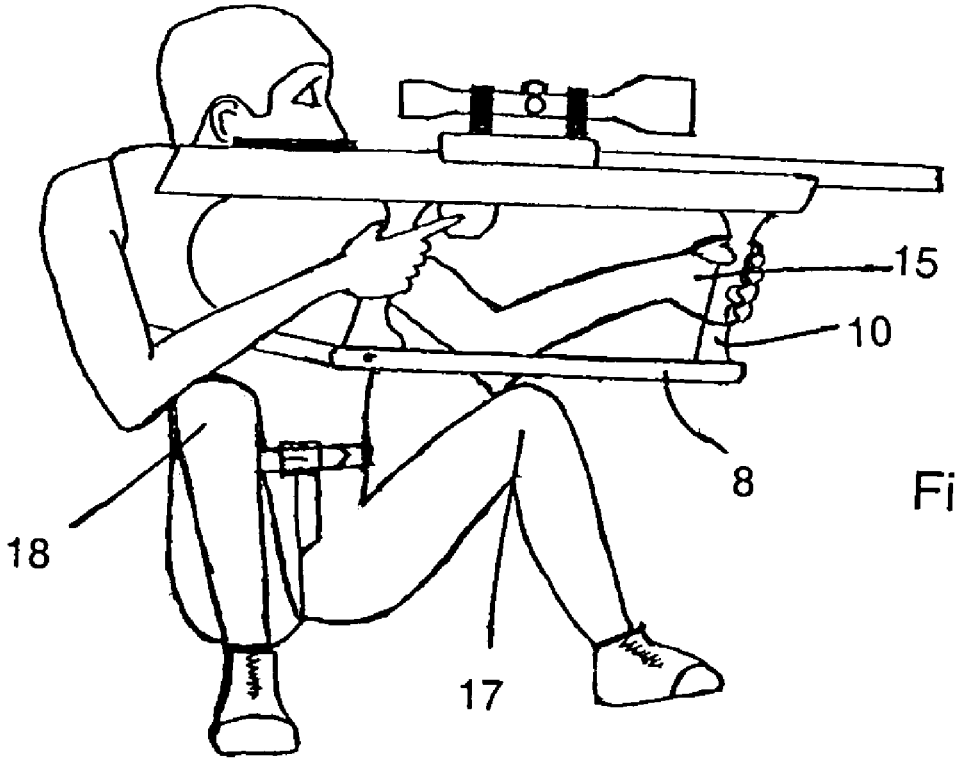
FIG. 13. shows an embodiment shown in FIG. 1, being fired from a second sitting position.

FIG. 13 also shows a shooter in the sitting firing position as per FIG. 11, though with the shooter's free hand (15) holding the second pistol grip (10).

Variants of this position include sitting with legs apart (as illustrated), sitting with knees (17, 18) apart though with feet touching and sitting with legs crossed. The said variants also encompass the 'classic' sitting position of an elbow on each knee and the free hand (15) on the first forestock (6).

Figure 14:
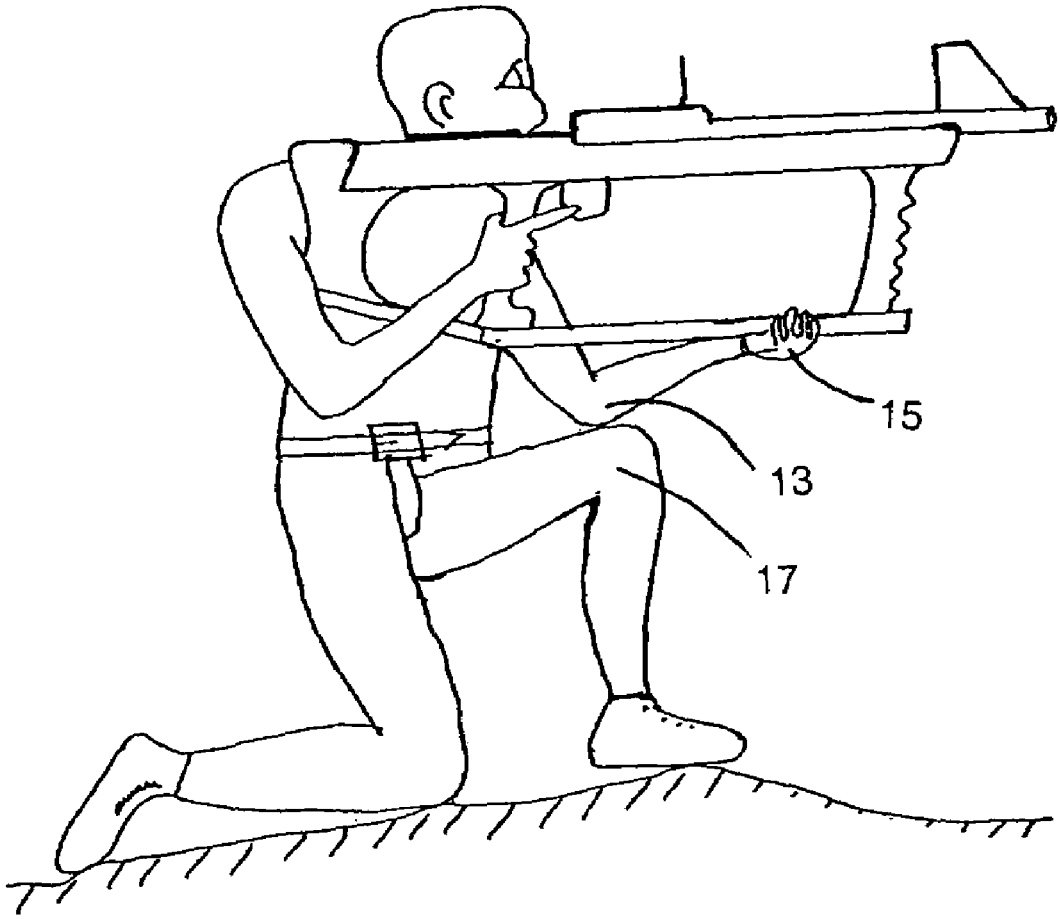
FIG. 14. shows an embodiment shown in FIG. 1, being fired from a second kneeling position.

FIGS. 12 and 14–16 show a shooter in the kneeling position, in which FIG. 12 shows the use of the 'hug' position (as described above) with the free arm's elbow (13) resting on the knee of the leading leg. In FIG. 14, the shooter rests the free arm elbow (13) on the leading knee (17), whilst the free hand (15) supports the lower second forestock (8).

Alternatively, the lower second forestock (8) may be rested directly on the shooter's leading knee (17) whilst the free hand grasps the second pistol grip (10), as shown in FIG. 15. Vertical height adjustment is possible without adversely affecting stability by placing the shooter's free hand (15) as a clenched fist, open palm, or just fingers between the lower second forestock (8) and the shooter's leading knee (17) as shown in FIG. 16.

The same technique of placing portions of the shooter's free hand (15) as a support under the lower forestock (8) (shown in an enlarged scale in FIG. 17*a*) may also be used for firing in the prone position as shown in FIG. 17. Forming the portion of the lower second forestock (8) rearward of the first pistol grip (5) with an upward inclination permits adjustments in the elevation of the whole weapon to be more easily effected by a shooter in a prone firing position. It will be appreciated that the shooter may alternatively support the weapon stock (1) by grasping the second pistol grip (10) or the upper forestock (6).

Figure 18:
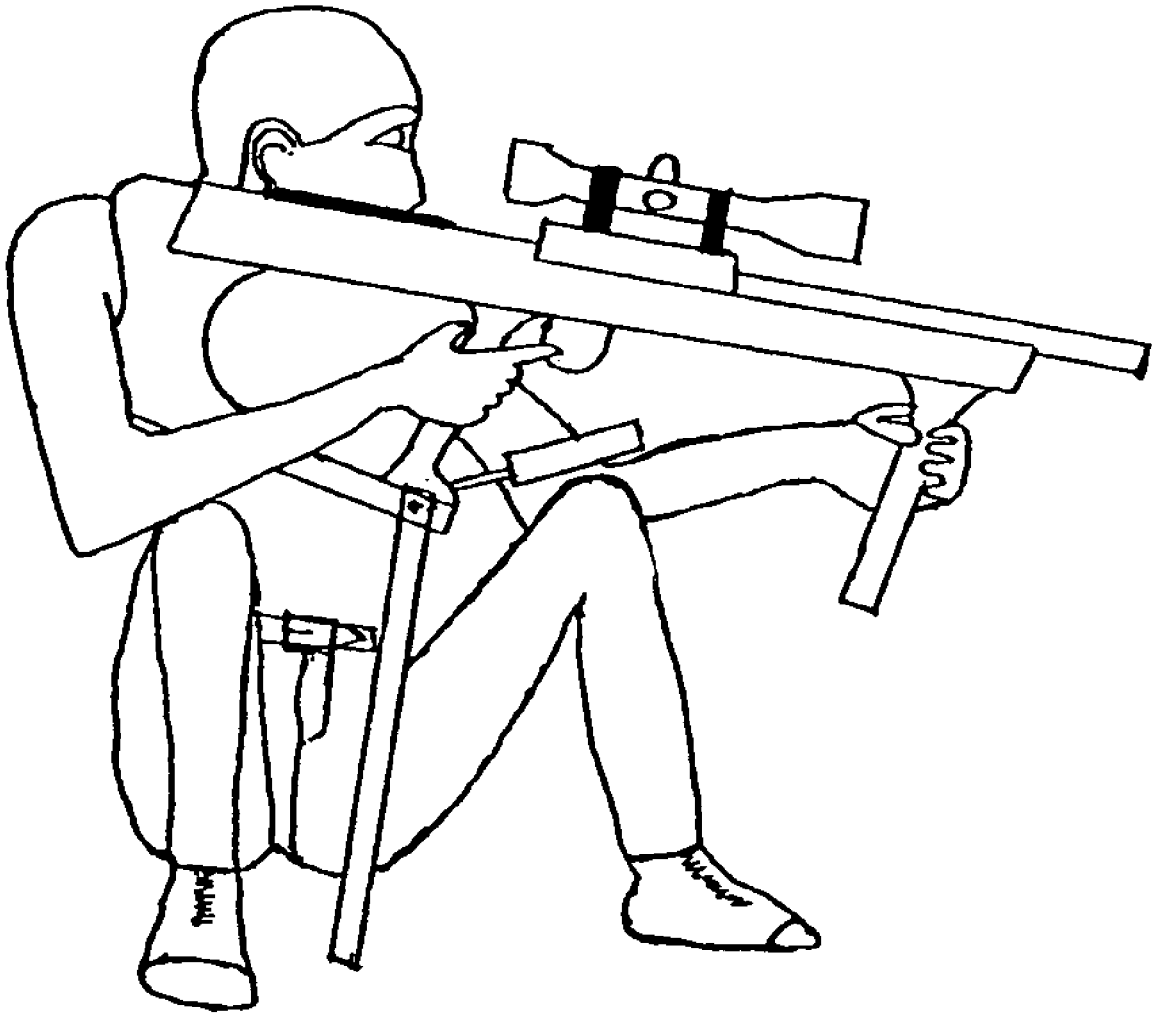
FIG. 18. shows a further embodiment shown in FIG. 1, being fired from a third sitting position.

Hinging the lower second forestock (8) to either the lower end of the second pistol grip (10)/bracing element (9) or the first pistol grip (5) and releasably attaching the other end of the lower second forestock (8) provides an optional means of deploying the lower second forestock (8) as a monopod support. FIG. 18 shows a shooter in a sitting position using the lower second forestock (8) as a monopod pivotally attached at the first pistol grip (5). The maximum vertical height of such a monopod is naturally governed by the length of the pivotable length of the lower second forestock (8). Shorter vertical heights may be accommodated by bracing the monopod/lower second forestock (8) at an incline with the ground. Greater lengths may be obtained from an extendible configuration of the second forestock (8), e.g. a telescopic construction.

Further embodiments of the present invention incorporate an integral means of supporting the weapon for carrying/transport in a directly comparable manner to use of a conventional sling. Instead of utilising a flexible length of material attached between two (or more) fixed points on the stock (1), the stock itself is configured to provide the effect of a sling.

Figure 19:
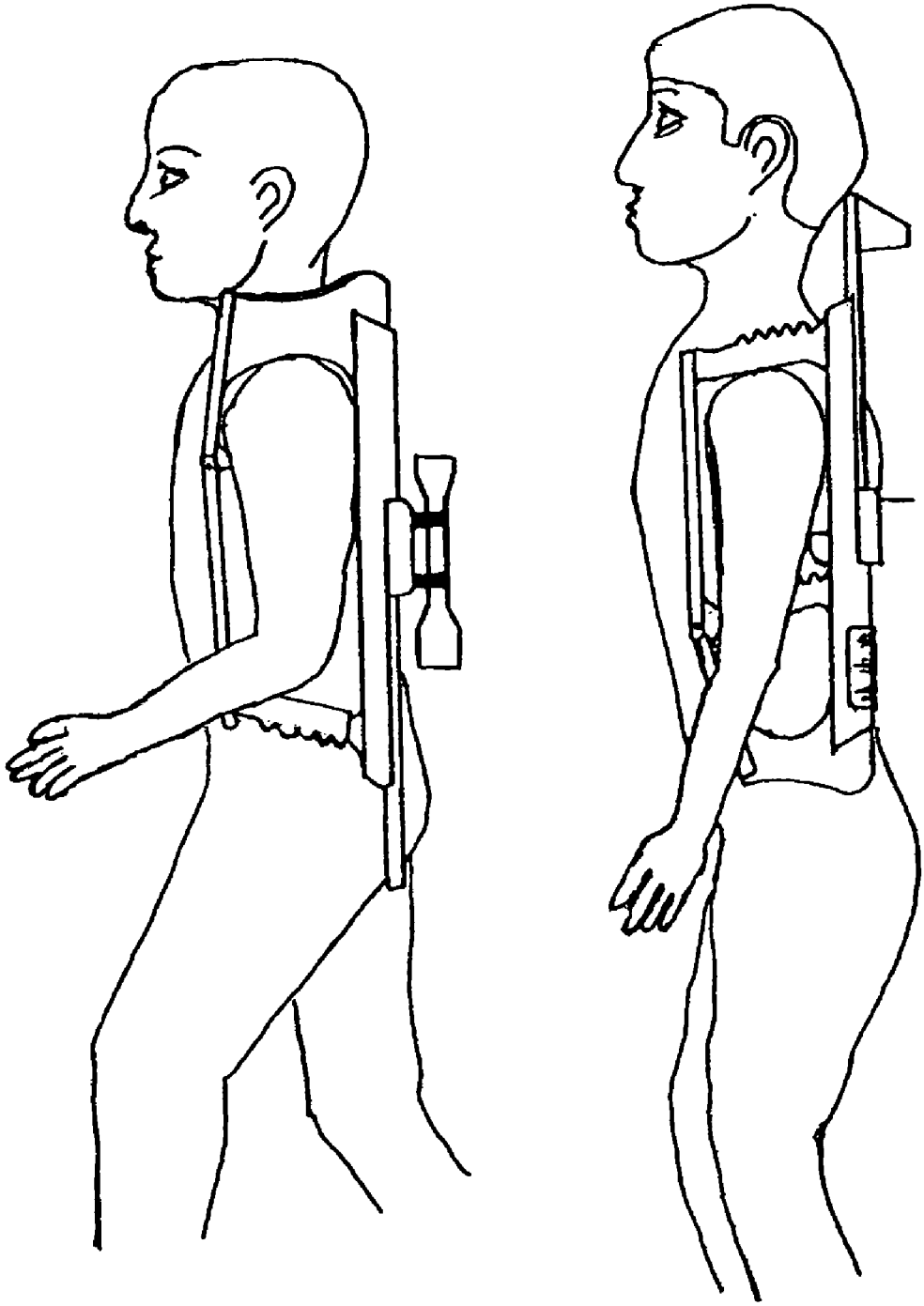
FIG. 19. shows an embodiment of the present invention, being carried over the shoulder of a user.

FIGS. 19*a*) and 19*b*) illustrate a shooter using two variants of such a 'stock sling'. Referring to both FIG. 1 and 19*a*), a rear 'stock sling' is shown, formed by a first opening defined by portions of the buttstock (7), lower second forestock (8) and first pistol grip (5) through which the shooter may insert an arm up to the shoulder and to rest the weapon thereupon. To match the generally rounded contours of the human shoulder, the rear portion (19) of said first aperture formed by buttstock (7), and the portion (20) of the lower second forestock (8) rear of the first pistol grip (5) are optionally configured with a concave profile. Further user comfort may optionally be provided by providing resilient material about the perimeter of said first aperture.

A further 'stock sling' may optionally be formed at the forward end of the stock by a second opening defined by the lower second forestock (8), the second pistol grip (10) and the upper forestock (6). In contrast to the rear stock sling, supporting the weapon by the forward stock sling (as shown in FIG. 19*b*) results in the shouldered weapon being orientated barrel upwards. In the case of a conventionally-designed stock (1*a*) adapted to receive a lower second forestock (8) (as shown in FIG. 2), a rear-stock sling is impractical to implement, though a forward stock-sling may still be incorporated if desired.

In yet further preferred embodiments, the present invention provides a convenient means of attaching to, and carrying weapon accessories on, the weapon stock (1). These accessories may take a variety of forms and may include, but are not limited to, bipods, extra handgrips, weapon magazines, bayonets, wire-cutters, communication devices, computational devices and grenade launchers and the like. The barrier-like properties afforded by a continuous lower second forestock (8) attached at both the first pistol grip (5) and the second pistol grip (10) creates a more secure manner of locating such accessories on the weapon itself than is possible with conventional stock configurations.

FIG. 1 shows the attachment of a bipod (21) between the upper first and lower second forestocks (6, 8), whereby the non-hinged ends of both legs are located in purpose designed recesses designed to prevent inadvertent release.

Figure 20:
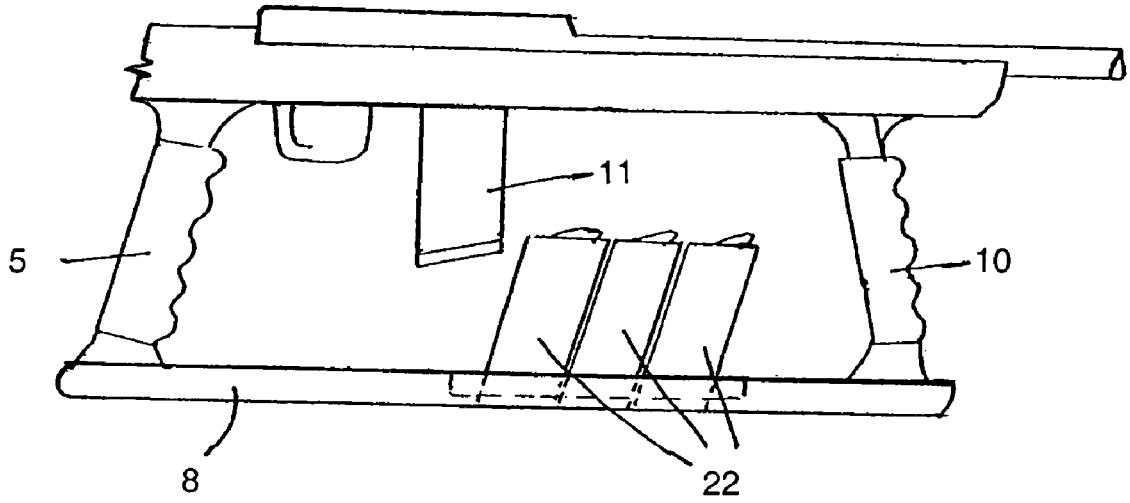
FIG. 20. shows a further embodiment of the present invention.

FIG. 20 shows a further embodiment in which supplementary weapon magazines (22) are located on the upper surface of the lower second forestock (8). According to one embodiment, the securement means for the supplementary weapon magazines (22) is configured such that unless the existing magazine (11) inserted into the firing assembly is removed, release of a supplementary magazine (22) is prevented.

Figure 21:
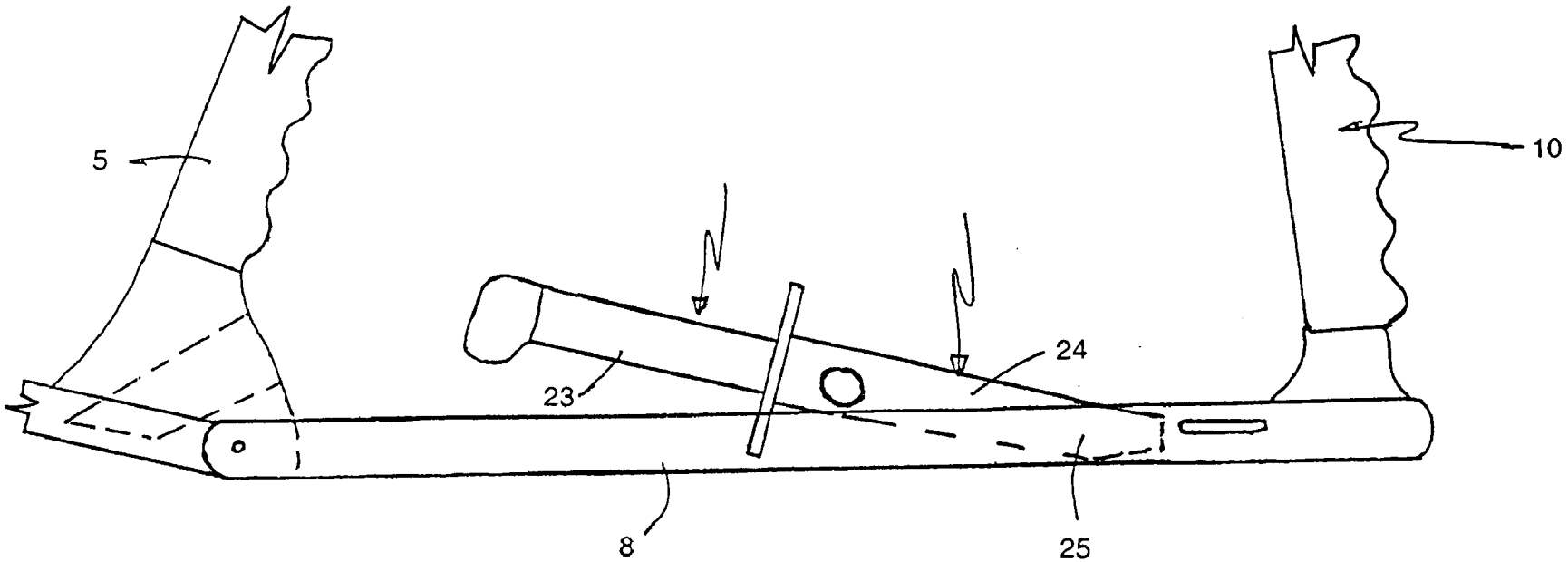
FIG. 21. shows a further embodiment of the present invention.

FIG. 21 illustrates the attachment of a bayonet (23) to the lower second forestock (8) via a bayonet sheath (24) mounted in an inclined slot (25) in the second forestock (8).

The above-described examples of weapon accessories are in no way limiting and are made solely by way of illustration and explanation only.

Placing an unused weapon in an upright position, such as in a conventional gun-rack, is not always possible or convenient.

Figure 22:
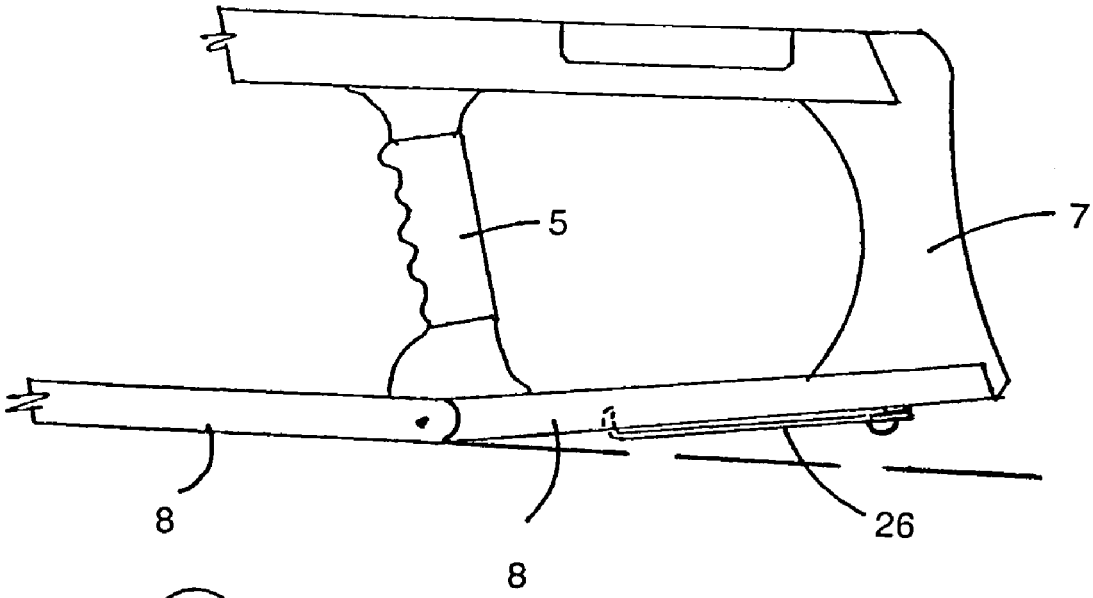
FIG. 22. shows a further embodiment of the present invention.
Figure 22:
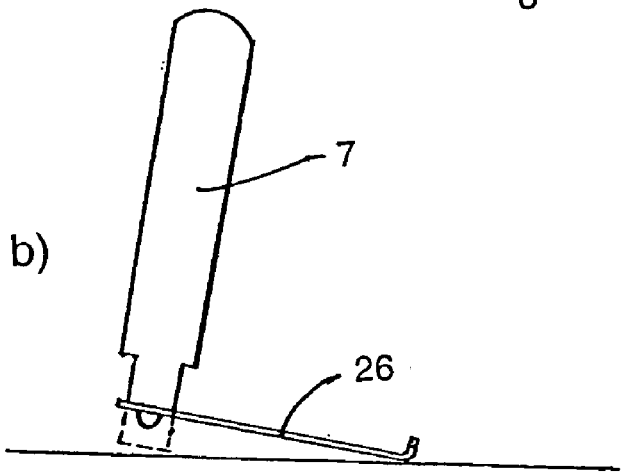
Figure 22:
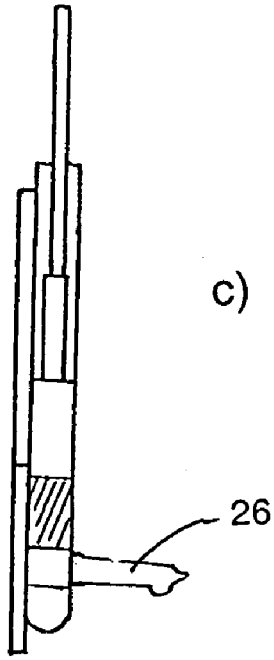

FIG. 22 shows a support element (26) attached to the buttstock (7). The support element (26) is formed as an elongate strut rotatably attached at one end to the buttstock (7) and capable of being rotated laterally outwards from the stock to support the stock (1) in a substantially horizontally upright position when placed on a firm surface. FIG. 22*a* shows the support element (26) in a stowed position whilst FIG. 22*b*) and *c*) respectively show end elevation and plan view of the support element (26) deployed.

Although a single support element (26) is shown attached to the buttstock (7), it will be readily appreciated that the invention is not necessarily restricted so. Multiple support elements (26) may be provided if desired, attached at any convenient position along the lower second forestock (8) and/or buttstock (7).

The attachment of the lower second forestock (8) to any or all of the first pistol grip (5), second pistol grip (10) or buttstock (7) need not necessarily be rigid or unadjustable. In alternative embodiments, releasable, slidable, pivotable, and/or detachable attachments of the lower second forestock (8) many be employed.

Figure 23:
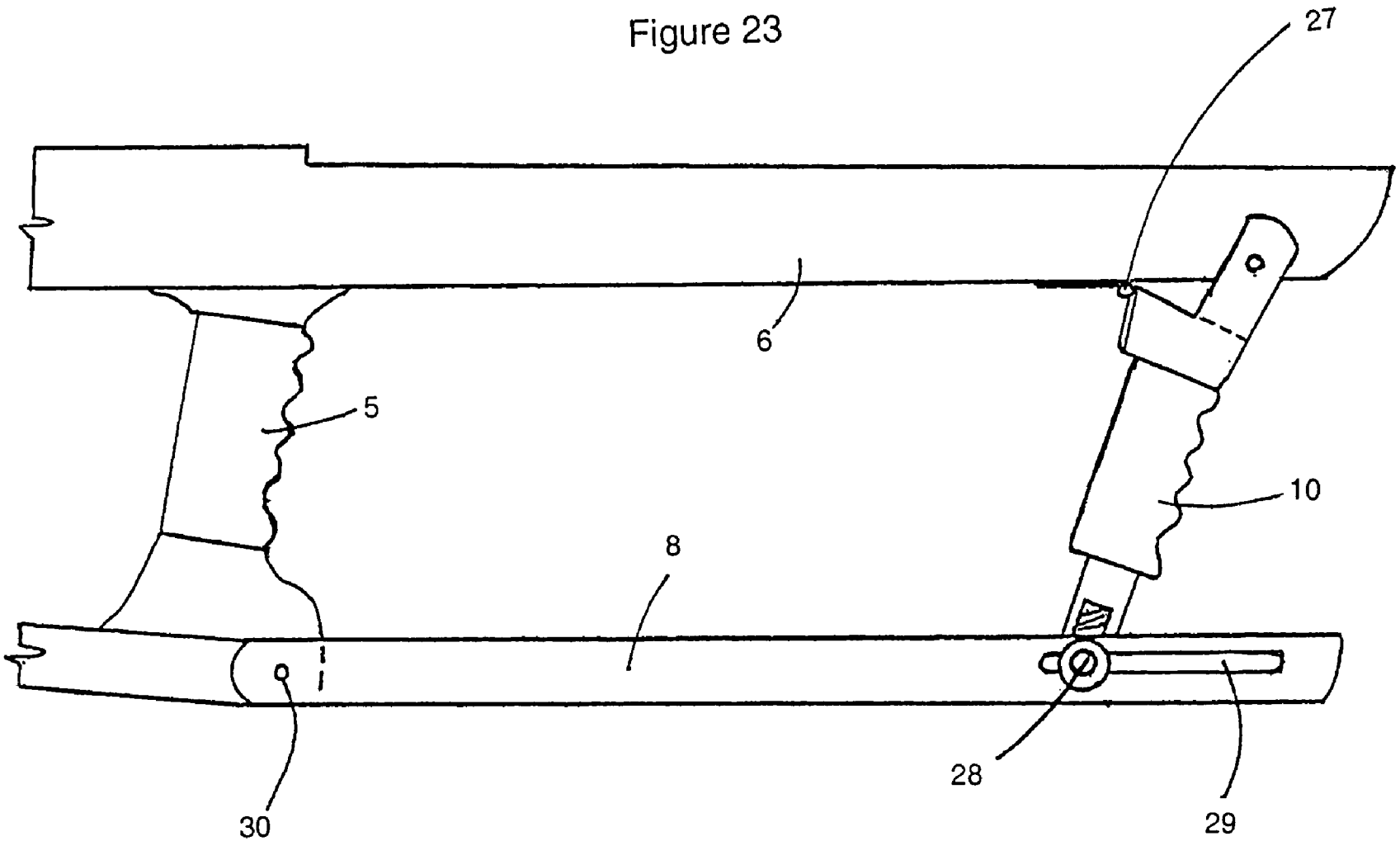
FIG. 23. shows a further embodiment of the present invention.

FIG. 23 illustrates an embodiment in which the second pistol grip (10) is pivotally attached to the first forestock (6) by hinge (27). The lower end of the second pistol grip (10) is slidably attached to the lower second forestock (8) by a transverse pin or threaded bolts (28) protruding through an elongated longitudinal (or arcuate) slot (29) extending through the sidewalls of the lower second forestock (8).

The bolts (28) threaded into the base of the second pistol grip (10) provide a means of releasably securing the second pistol grip at a particular location within the slot (29), thus providing adjustment of the angle of inclination of the second pistol grip (10).

FIG. 23 shows the second pistol grip located near the rear-most position within the slot (29), giving a rearward second pistol grip (10) inclination.

Figure 24:
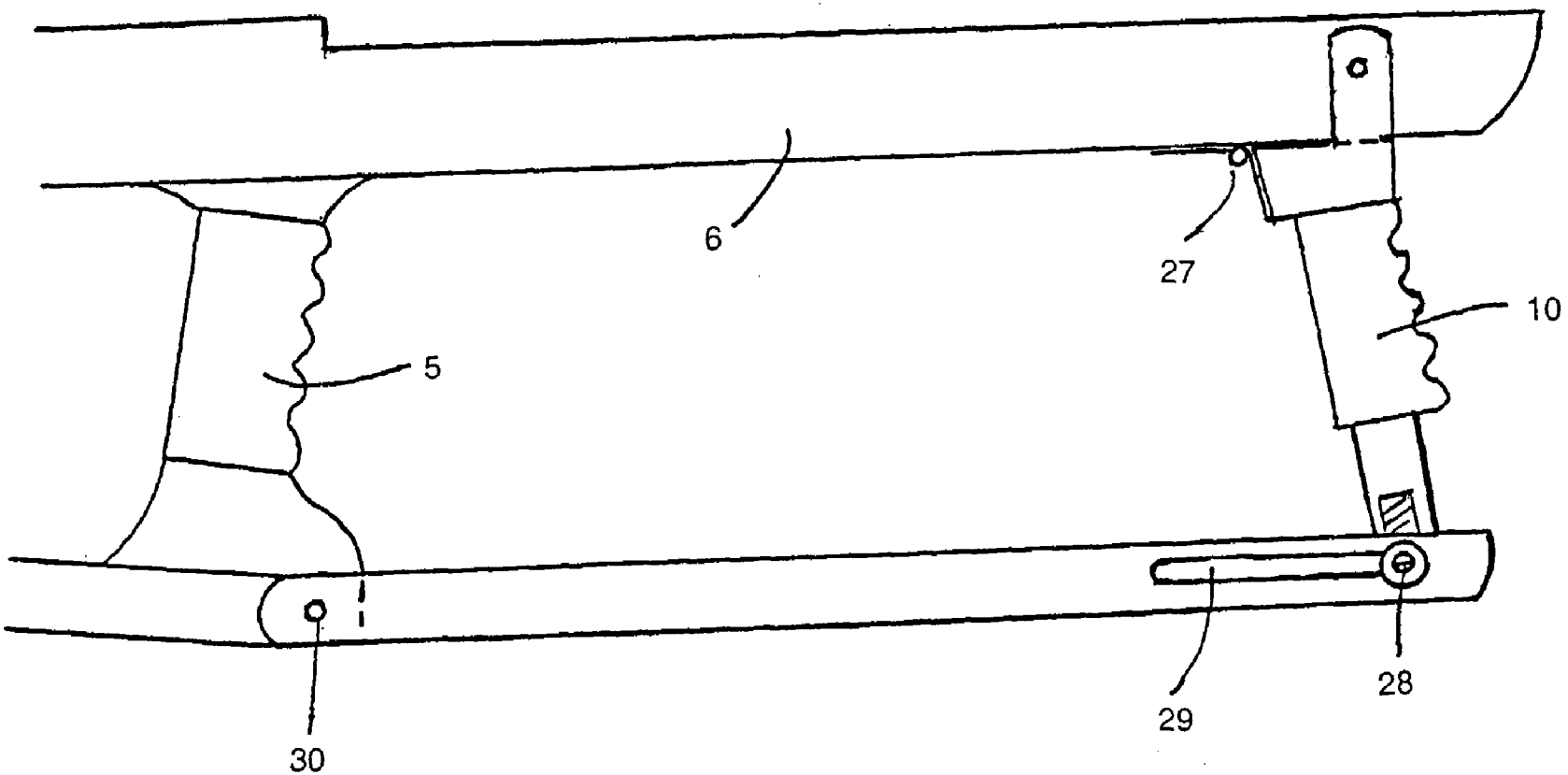
FIG. 24. shows a further aspect of the embodiment shown in FIG. 23.

In comparison, FIG. 24 shows the second pistol grip (10) secured at the front-most location of the slot (29), to give a forward second pistol grip (10) inclination. The angular change of the lower second forestock (8) at the attachment point to the first pistol grip (5) caused by sliding the second pistol grip (10) along the slot (29) is accommodated by a pivot (30). If, as mentioned above, the slot (29) is arcuate, transcribing a part-circular arc about the hinge (27), then attachment of the lower second forestock (8) to the first pistol grip (5) need not be pivoted.

Figure 25:
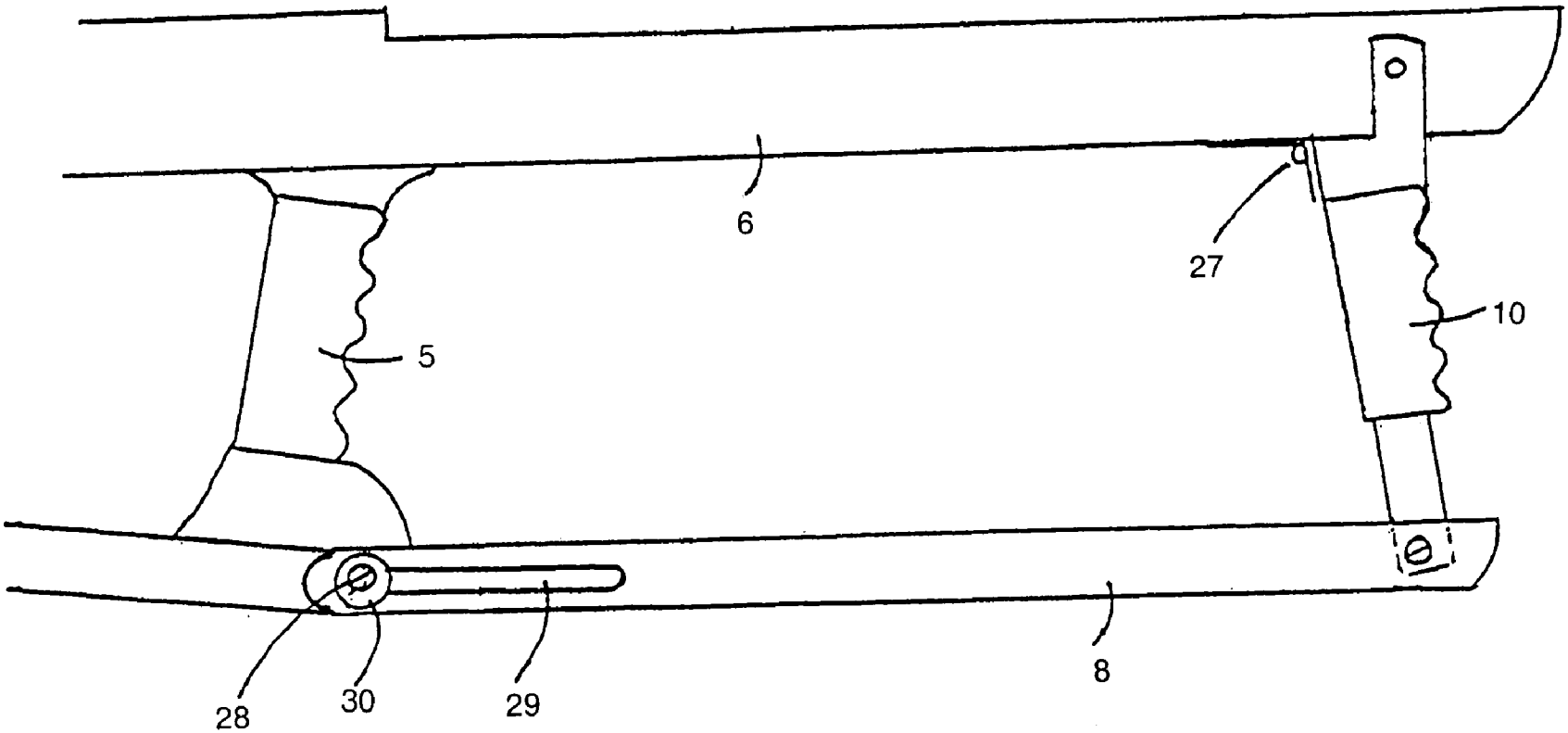
FIG. 25. shows a further embodiment of the present invention.

The slot (29) need not necessarily be located at the forward end of the lower second forestock (8) (as shown in FIGS. 23 and 24), but may instead be formed at the attachment point to the first pistol grip (5) as shown in FIG. 25. In this embodiment, the attachment of the second pistol grip (10) to the lower second forestock (8) is pivotable, but not slidably adjustable.

Figure 26:
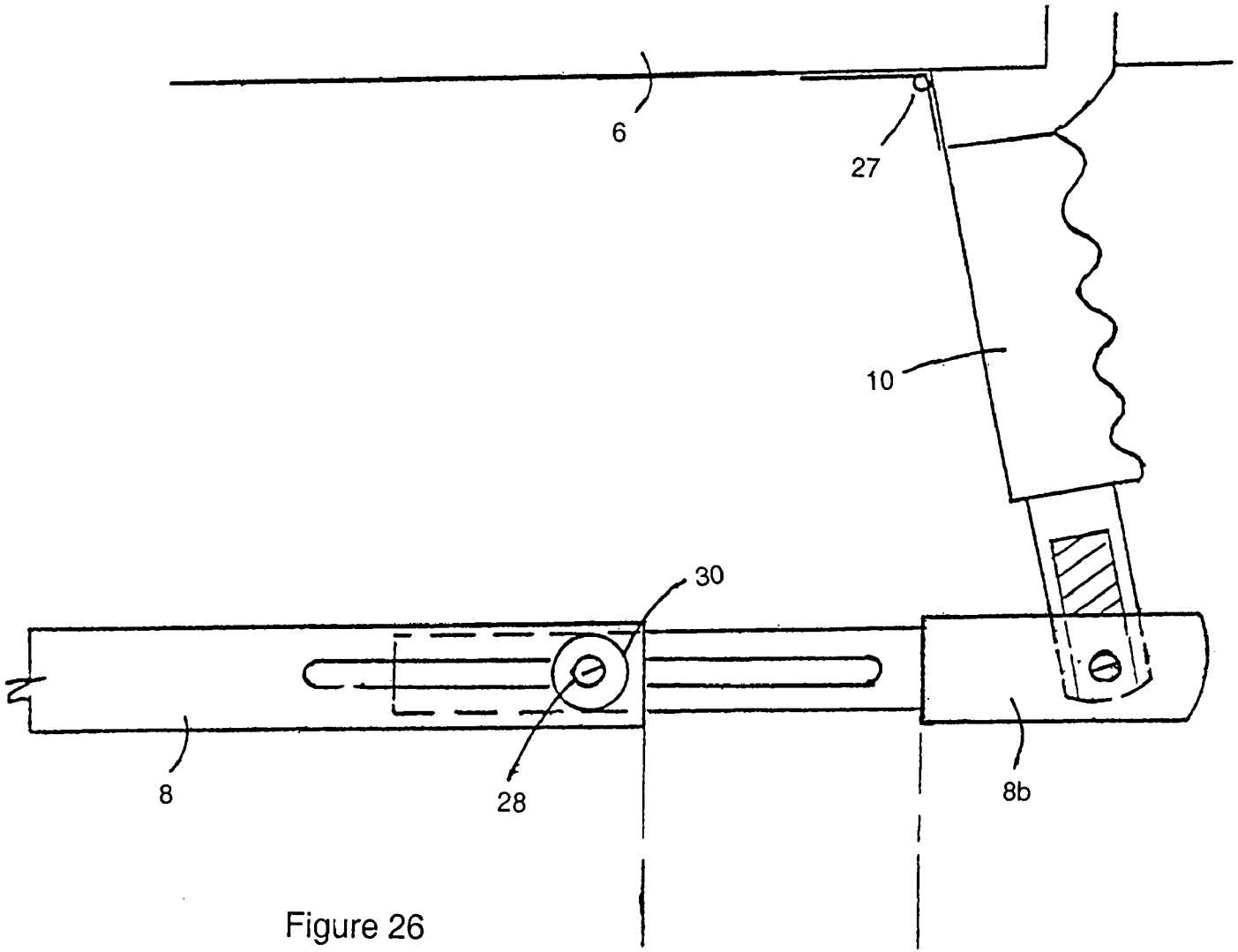
FIG. 26. shows a further embodiment of the present invention.

In yet further embodiments, the simple slidable attachment configuration shown in FIGS. 23–25 may be replaced by a telescopic configuration as shown in FIG. 26. Instead of the second pistol grip (10) being slidably securable within a slot in the lower second forestock (8), the second pistol grip (10) is pivotally attached to a portion (8*b*) of the lower second forestock (8). This portion (8*b*) is telescopically attached to the remainder of the lower second forestock (8).

Although FIGS. 23–26 show an adjustable angle second pistol grip (10) as part of a purpose/designed stock (1), an existing weapon stock such as that shown in FIG. 2 may be adapted to incorporate the same features.

Figure 27:
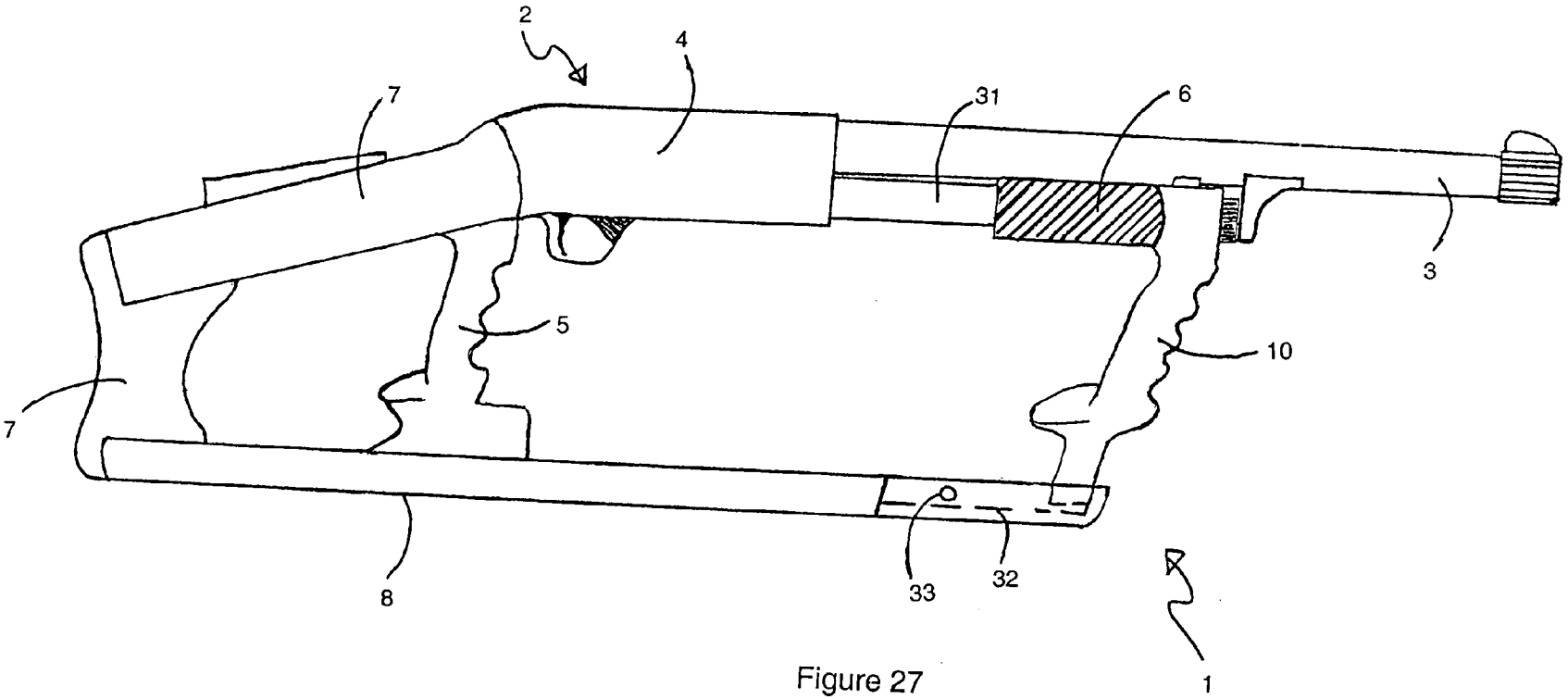
FIG. 27. shows a further embodiment of the present invention in the form of a pump-action weapon.
Figure 28:
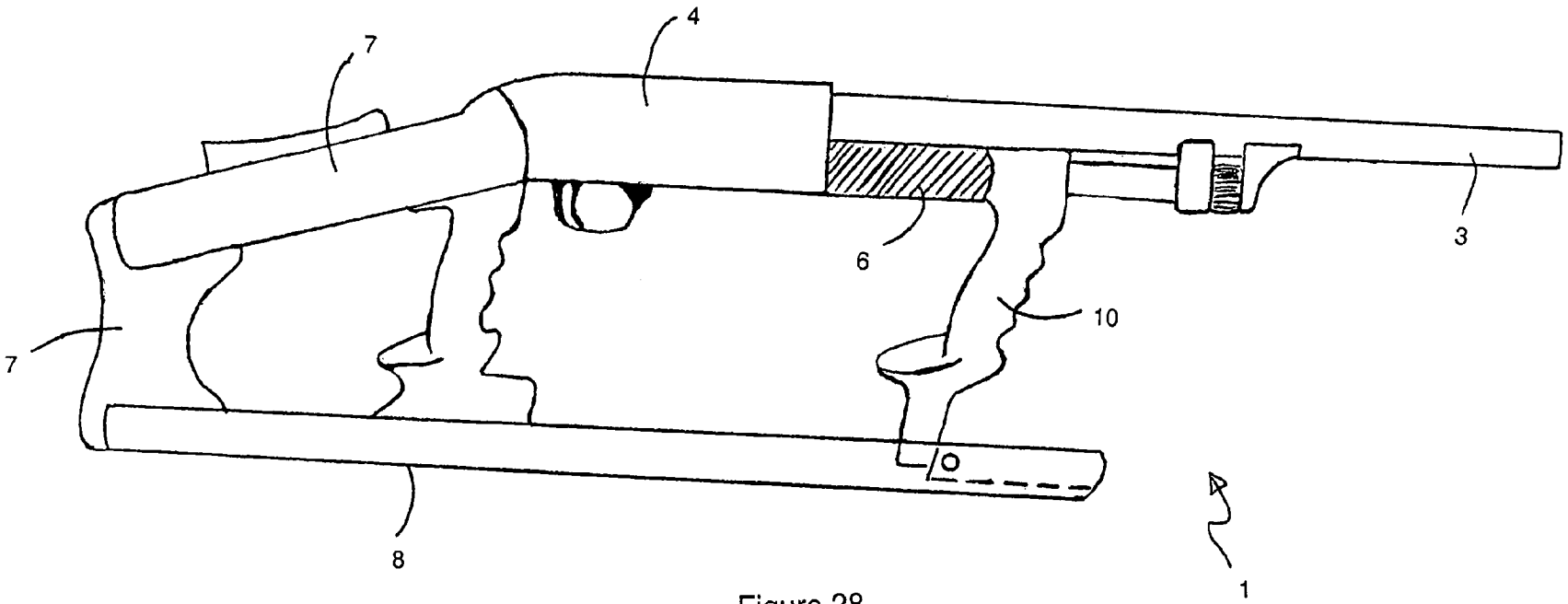
FIG. 28. shows a further view of the embodiment shown in FIG. 27.

FIGS. 27 and 28 show a further embodiment of the present invention applied to a pump-action weapon In this embodiment, the upper first forestock (6) is a pump slide which is slidably attached to a guide tube/magazine (31) located directly below the barrel (3) and is shown (in FIG. 27) at the forward-most extent of its travel on the guide tube (31). A lower second forestock (8) is attached to the buttstock (7) and to the first pistol grip (8) and has a slidable attachment point to the lower end of the second pistol grip (10). In this embodiment, the slidable attachment of the lower forestock (8) is in the form of an internal slotted rail (32) extending longitudinally, configured to retain the pistol grip (10) captive within the slide rail (32). The pump slide pistol grip (10) is thus free to reciprocate in a linear motion parallel to the barrel. To eject a fresh cartridge (not shown) the pump slide (6) is pulled rearwards towards the buttstock (7) (as shown in FIG. 28), and then returned to the start position shown in FIG. 27 to chamber a fresh cartridge.

The addition of the second lower forestock (8) significantly enhances the structural integrity of the pumpslide mechanism. Conventional pump action weapons seldom employ unsupported freestanding second pistol grips (10) due to the potential malfunctioning of the pump mechanism from lateral or torsional forces applied to the pistol grip (10). These disadvantages are addressed by the present invention.

As a security aid, the lower forestock (8) includes an aperture (33) through the slide rail (32) through which a padlock (not shown) may be passed to prevent unauthorised operation of the weapon.

Figure 29:
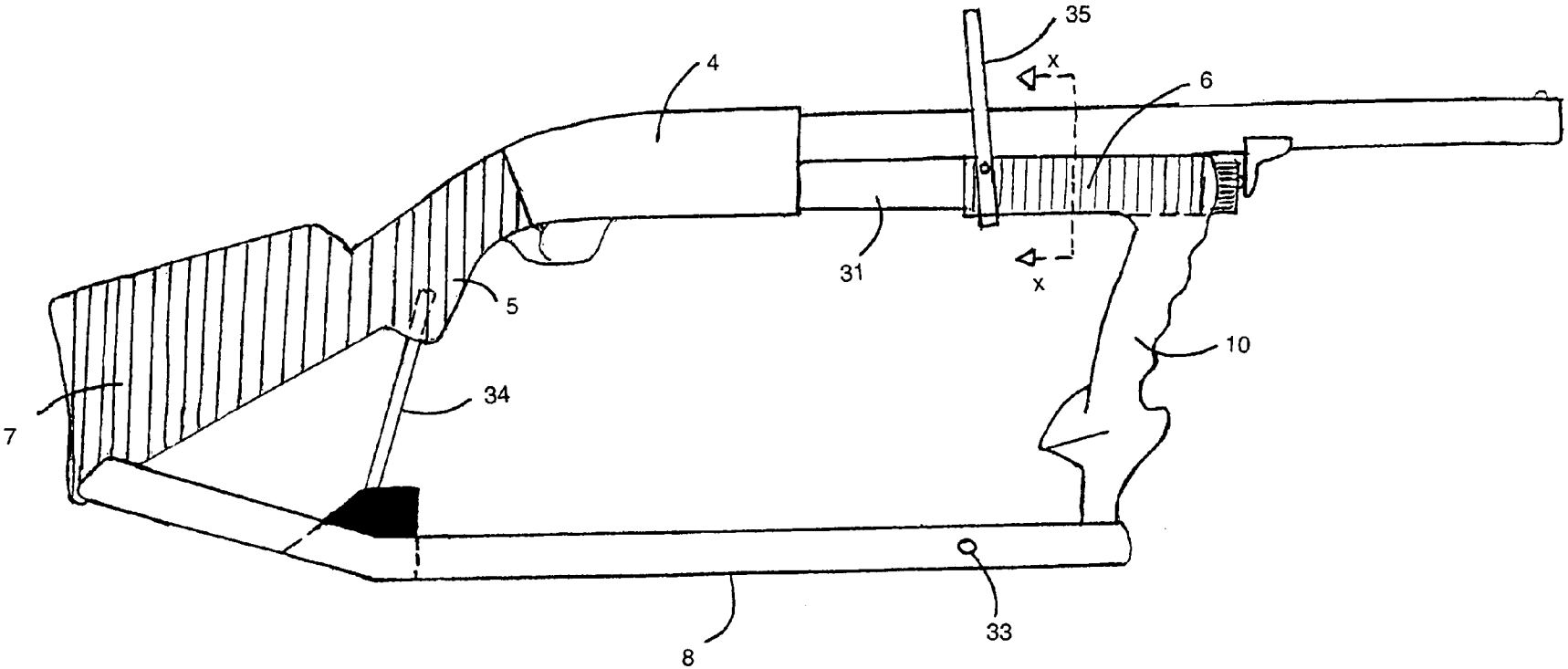
FIG. 29. shows an existing pump action weapon adapted to include a lower forestock.

FIG. 29 shows a comparable configuration to that described with respect to FIGS. 27 and 28 applied to the adaptation of an existing pump action weapon. Modifications required are limited to the replacement of the conventional forestock pump slide with the pistol grip slide (6) (or even attaching the second pistol grip to the existing pump slide (6)) and to addition of the second lower forestock (8) with attachment points at the second pistol grip (10), the first pistol grip (via connection rod (34) and to the buttstock (7).

Figure 30:
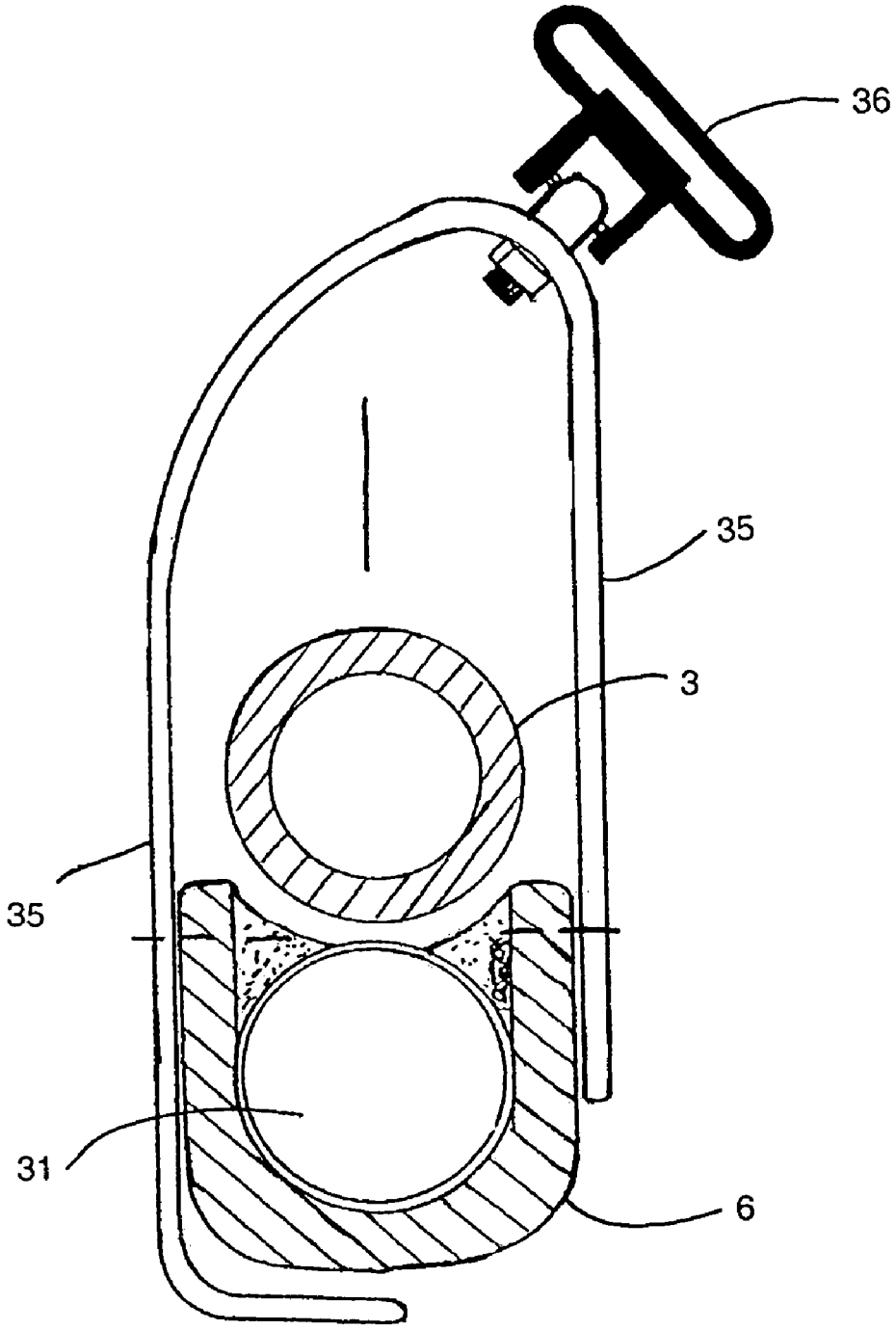
FIG. 30. shows a sectional view through XX shown in FIG. 29.

Also shown in FIG. 29 is a forestock sling attachment (35) attached to the pump slide (6). Again, the greater structural stiffness of the weapon with the addition of the lower forestock (8) permits the location of this attachment without adverse impact on the weapon functioning. FIG. 30 shows a transverse section through the barrel (3) and pump slide (6) along the section line XX shown on FIG. 29 and illustrates the lateral profile of the forestock sling attachment (35) and its associated sling swivel (36)

Figure 31:
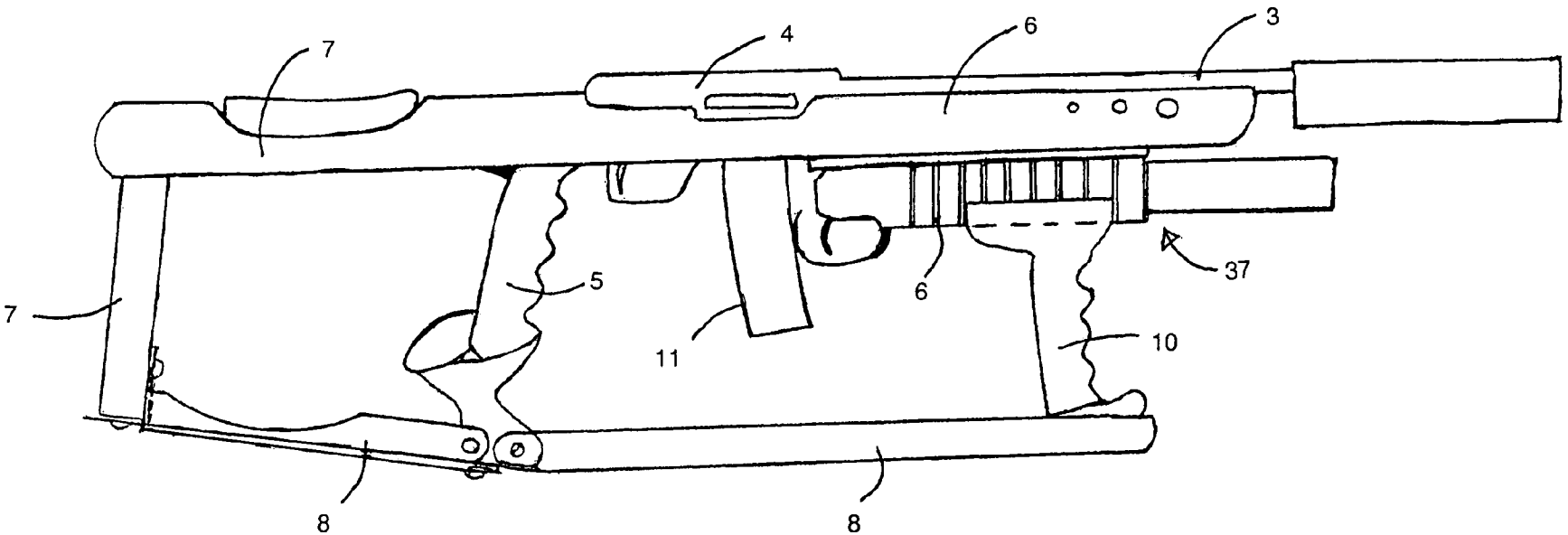
FIG. 31. shows an embodiment of the present invention adapted to interface with a grenade launcher, FIG. 32. shows a further embodiment of the present invention.

A further adaptation of the embodiment described with reference to FIGS. 27–30 is shown in FIG. 31. Although this embodiment shows the second pistol grip (10) attached to the pump slide (6*a*) of a grenade launcher (37), the main difference lies in the reloading sequence. Conversely to the pump action of the above embodiments, the grenade launcher ejects the spent round on the outward 'push' stroke away from the shooter and reloads on the rearward stroke pulled towards the shooter. Again, the pumping action is a linear reciprocating motion and the lower end of the second pistol grip (10) is restrained within the second lower forestock (6) accordingly.

Figure 32:
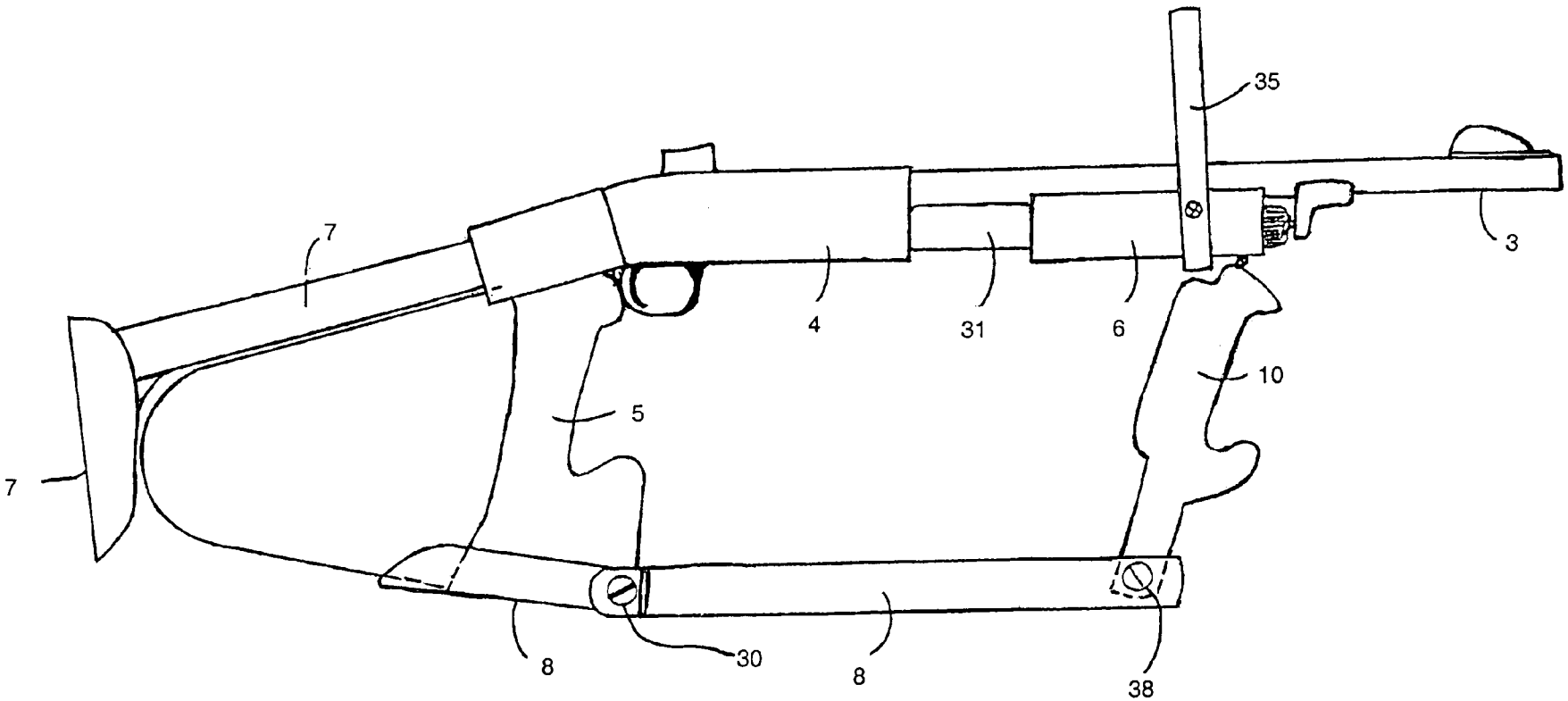

In contrast, FIG. 32 shows an embodiment with a different weapon cycling action where the attachment point of the lower forestock (8) to the second pistol grip is a fixed-location pivot/hinge (38) and not a sliding attachment The loading/ejection operation of the pump mechanism is still a conventional 'pull' stroke operation as described with respect to FIGS. 27–29. However, the linear movement of the second pistol grip (10) is replaced by an arcuate movement, pivoting about the pivot (38). The consequential alteration in the angle of the lower forestock (8) as the pistol grip (10) travels through its arc of movement is permitted by the hinged attachment point (30) of the second forestock (8) to the first pistol grip (5). Alternatively, a vertical slot may be formed in the lower forestock (8) of the attachment point with the second pistol grip (10). This permits vertical movement of the attachment point (38) during pumping action while enabling a rigid lower forestock (8) attachment to the first pistol grip (5) and/or buttstock (7).

Figure 33:
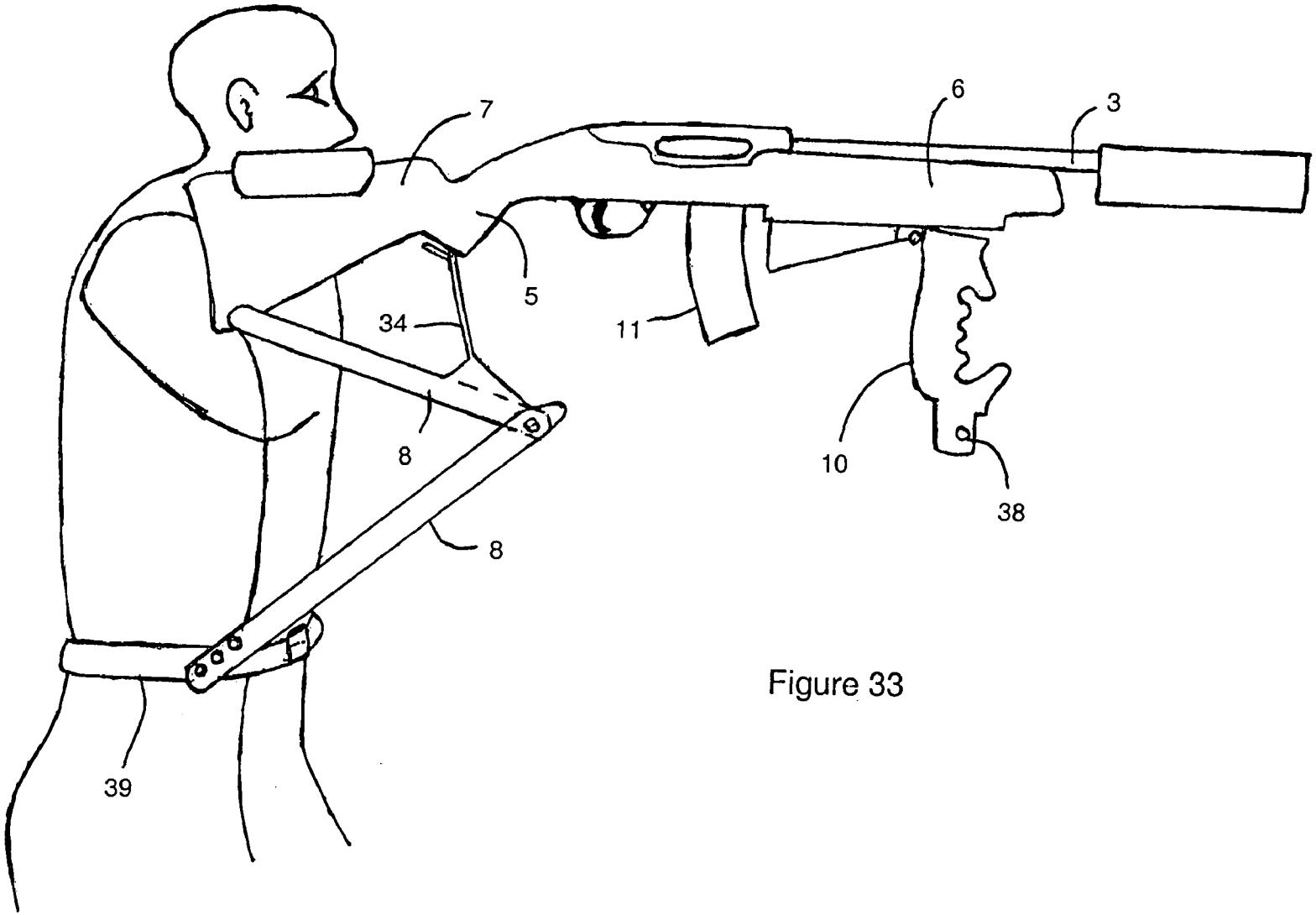
FIG. 33. shows an application of the lower forestock in a standing shooting position according to a further embodiment of the present invention.
Figure 34:
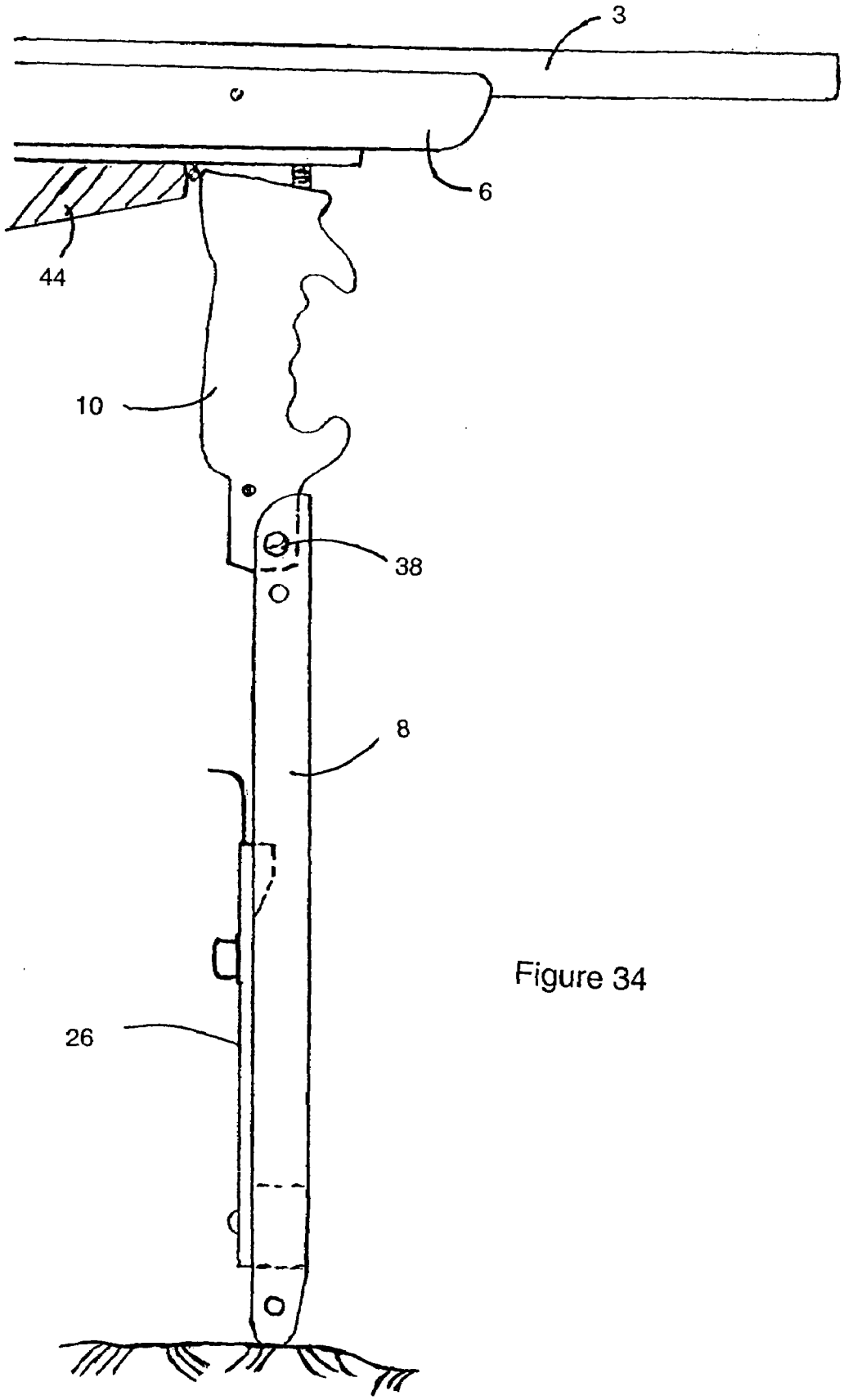
FIG. 34. shows a enlarged view of the lower forestock in use as a monopod according to a further embodiment of the present invention.
Figure 35:
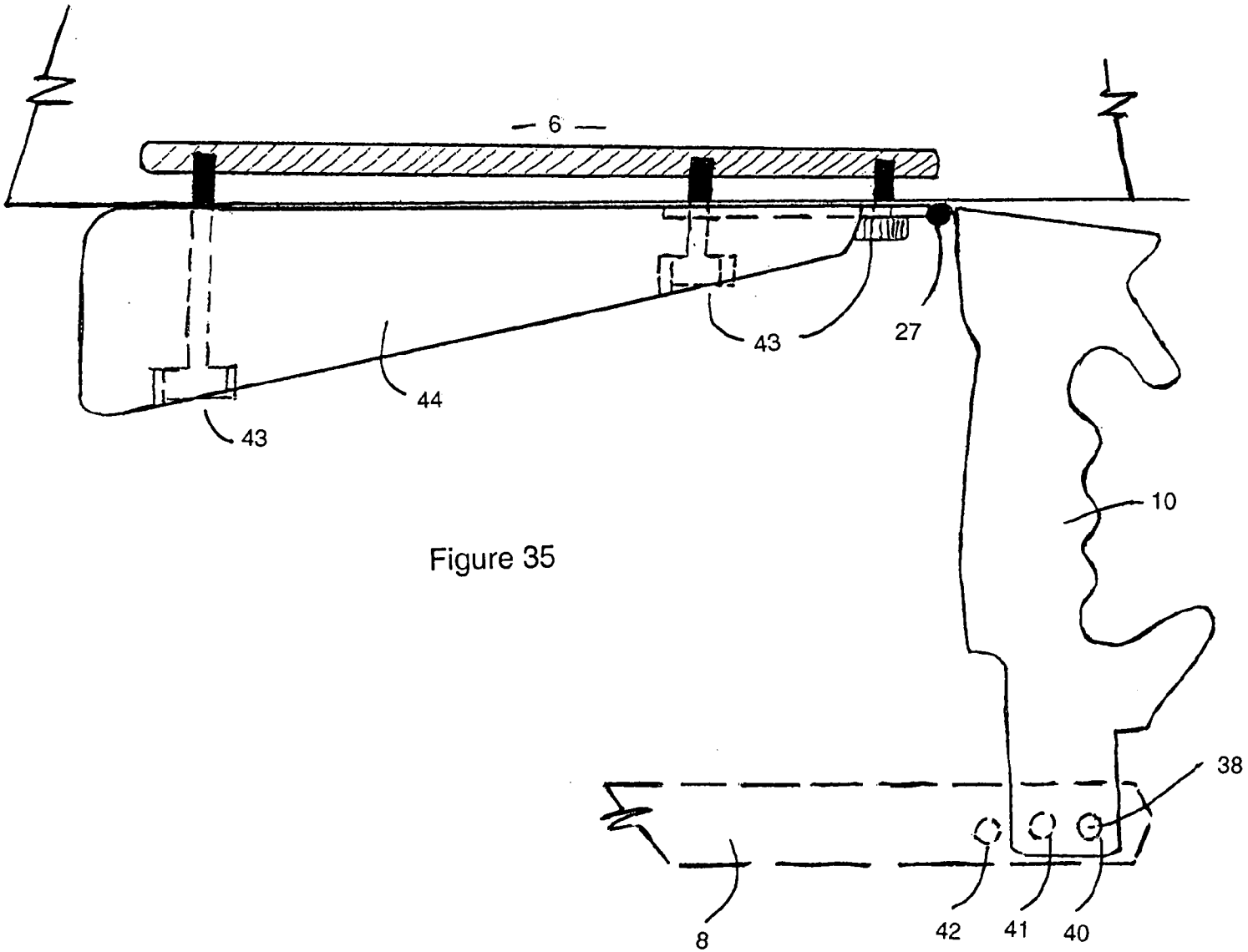
FIG. 35. shows an enlarged view of a second pistol grip attachment point according to a further embodiment of the present invention.

It will be appreciated that pump-action weapons are but one of numerous applications for the present invention. FIG. 33 shows the use of the second lower forestock (8) as a shooting/targeting support. The lower second forestock (8) is detached from the second pistol grip (10) and rotates about the pivot (30), with the free end then being clipped to the shooter's belt (39), or a purpose designed scabbard or holder (not shown) worn by the shooter. Such a feature is clearly suited for standing firing positions and instances requiring prolonged target surveillance (e.g. border guards) and hunters shooting from tree blinds and the like.

Where a sitting or crouching shooting position is possible/required, the detached free end of the second forestock (6) may be placed directly on the ground as shown in FIG. 34. FIG. 35 shows in greater detail one attachment point configuration between the second pistol grip (10) and the first forestock (6) and the second forestock (8) such as also shown in FIG. 34. The second pistol grip (10) is in this embodiment attached via hinge (38) fixed to the second lower forestock through one of three apertures (41, 42, 43). The multiple apertures provide a means of varying the pistol grip (10) inclination. The upper end of the second pistol grip (10) is pivotally attached to the first forestock (6) via hinge (27) attached to palm swell (44). In an alternative embodiment (not shown) the inclination of the second pistol grip (10) may be determined by an adjustable screw or stop at the upper portion of the second pistol grip (10), while the lower end is attached to the second forestock (8) via a slot of some form. In the embodiment shown in FIG. 35, the second pistol grip (10) is also slidably adjustable by appropriate slackening and tightening of bolts (43) passing through palm swell (44). The palm swell is movable within a defined linear distance below the first forestock (6) and thus also defining the angular orientation/inclination of the second pistol grip (10).

Figure 36:
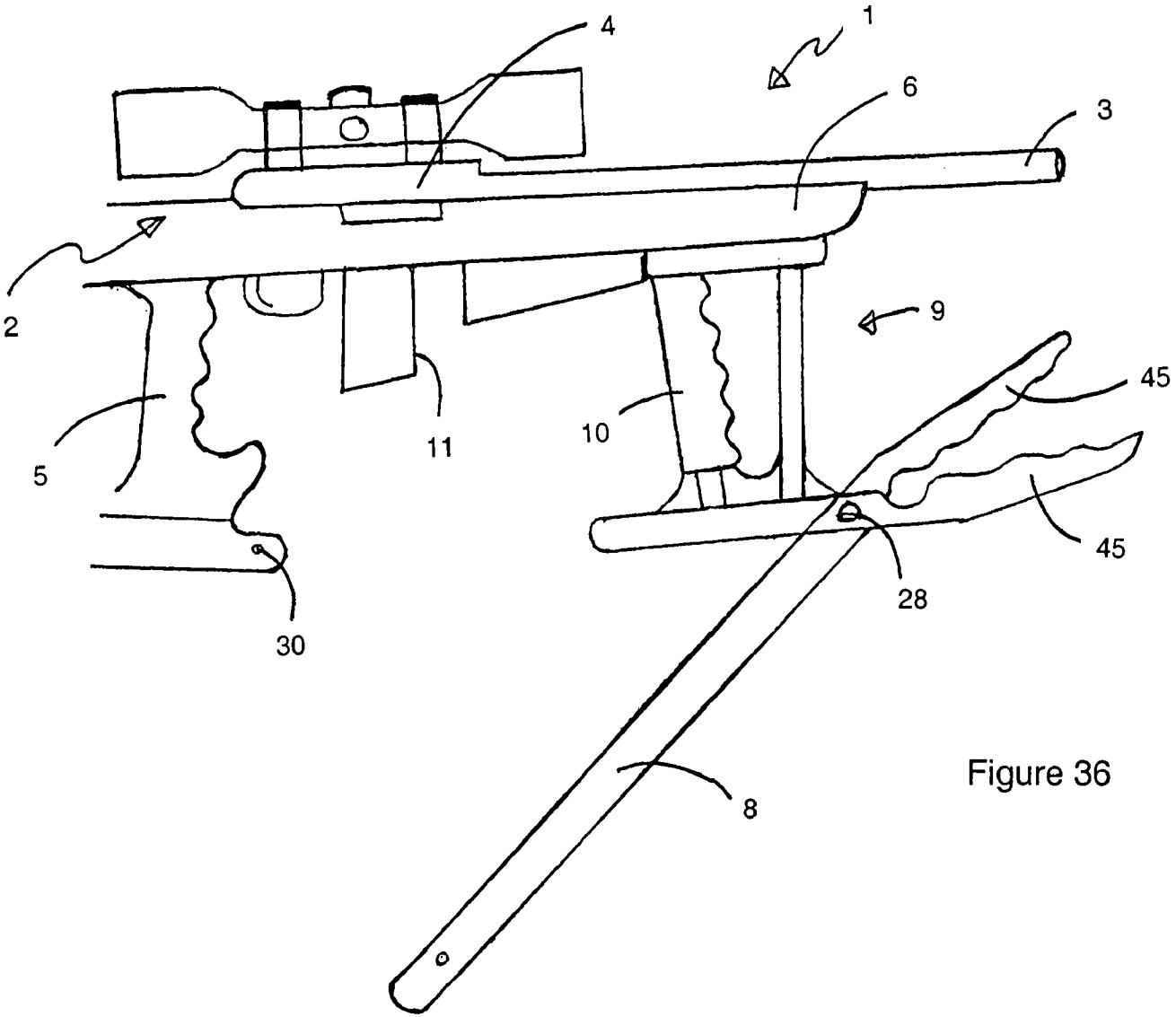
FIG. 36. shows a use of the lower forestock as lever action tool according to a further embodiment of the present invention.

A yet further example of the versatility of a lower second forestock (8) is shown in FIG. 36, whereby the second forestock (8) detached from the first pistol grip (5) forms a 'nutcracker' type configuration with a lower portion of the second pistol grip (10). Also, by the addition of a pair of extended jaws (45) (as a continuation of the two nutcracker lever arms), the 'nutcracker' lever arm configuration may be made into a scissor-type wire cutter/crimper or the like.

Figure 37:
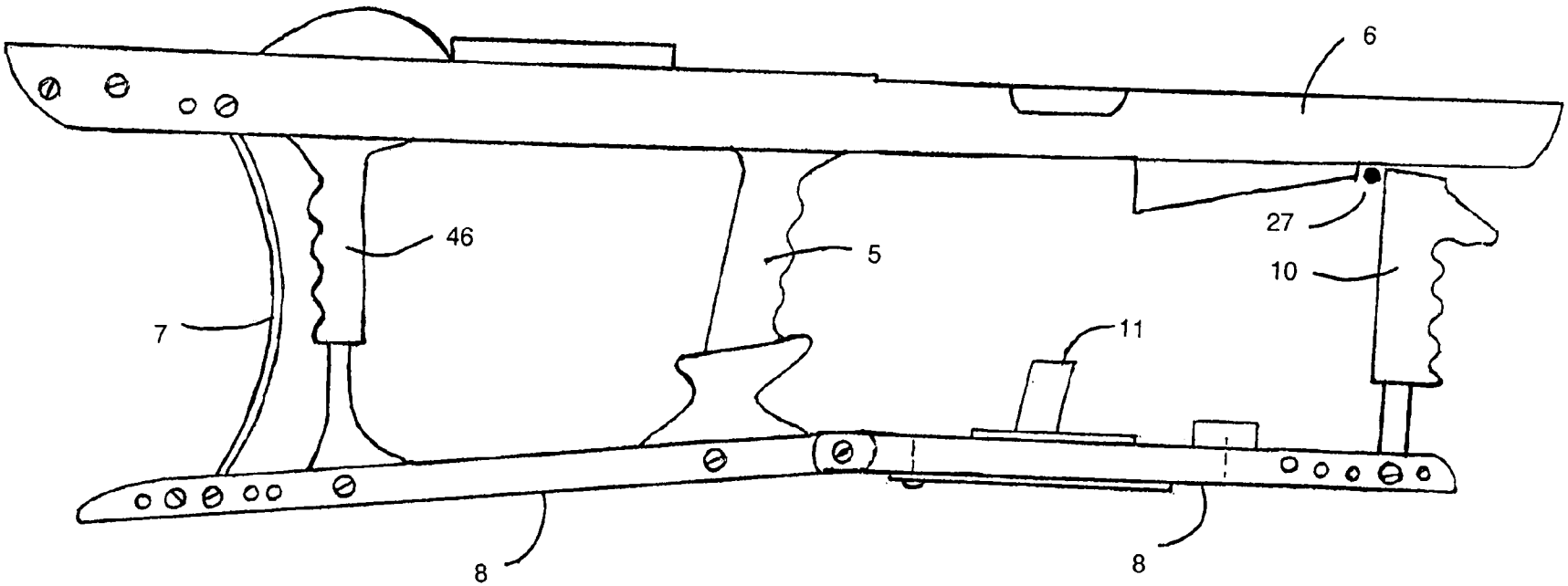
FIG. 37. shows a further embodiment of the present invention.
Figure 38:
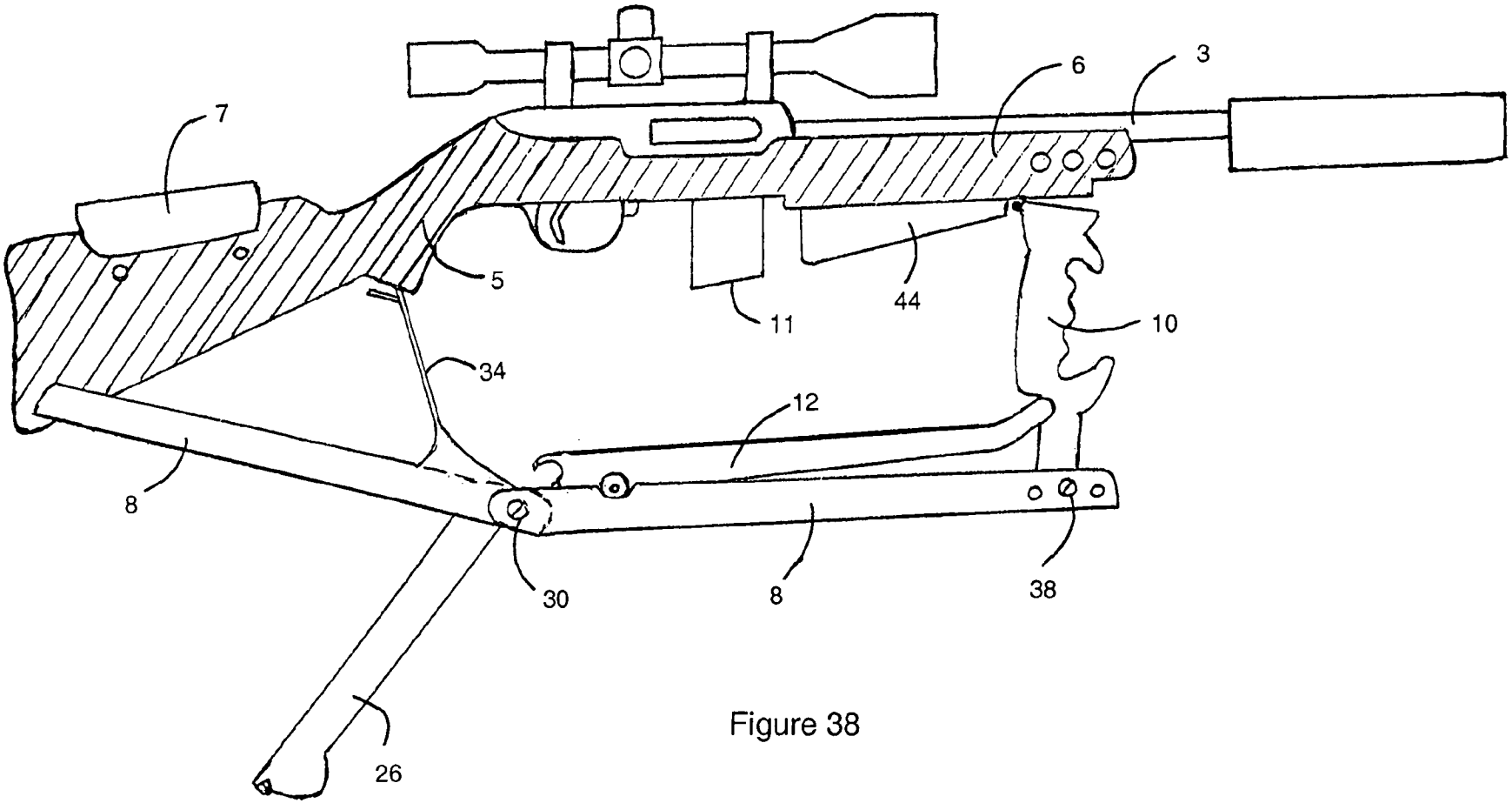
FIG. 38. shows a further embodiment of the present invention interfaced with an existing semi-automatic rifle.
Figure 39:
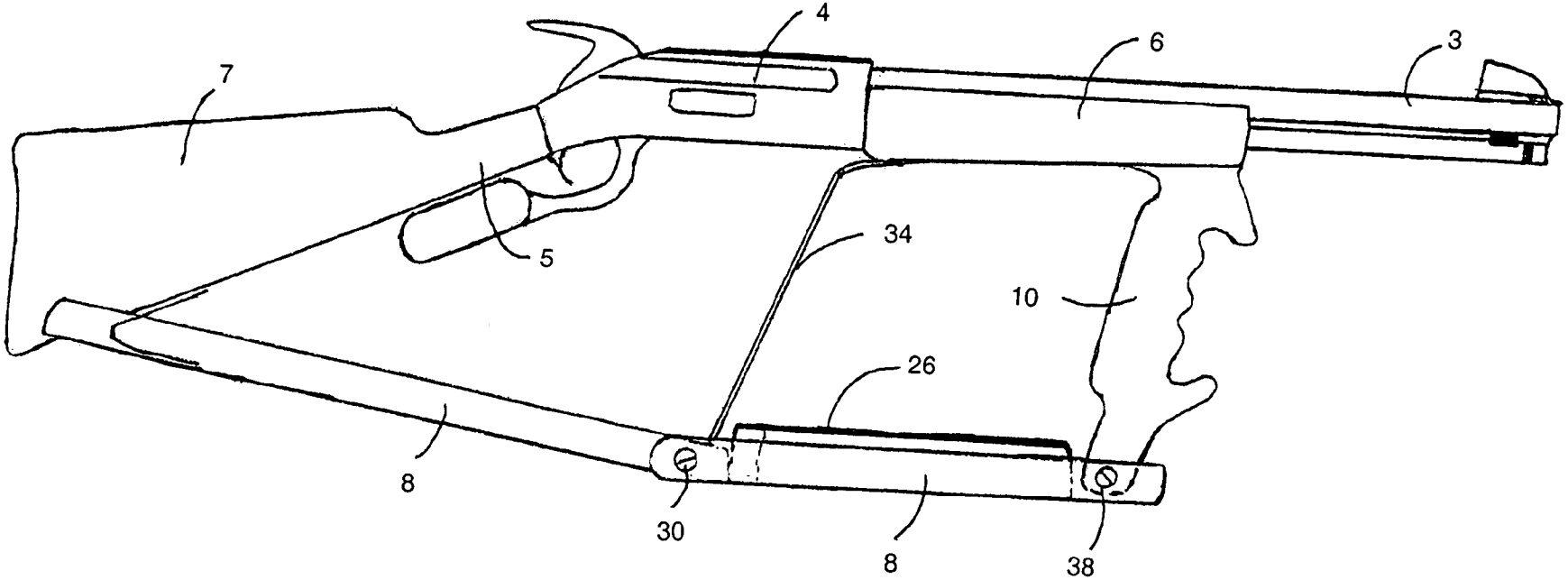
FIG. 39. shows a yet further embodiment of the present invention interfaced with a lever-action weapon.

By way of further example to illustrate the potential diversity of stock configurations possible with the present invention, FIGS. 37–39 show further weapon stocks (1), wherein FIG. 37 shows a stock where the second lower forestock (8) attachment points are at the butt stock (7), the first pistol grip (5) and the second pistol grip (10) and wherein the second forestock slopes down from the first pistol grip (5) towards the buttstock (7). The stock further includes a rearward facing third pistol grip (46) located between the buttstock (7) and the first pistol grip. (5) The rearwards third pistol grip provides a further handhold for the non-trigger hand of shooters using the aforesaid 'hug' position.

FIGS. 38 and 39 both show further examples of retro fitment of a lower second forestock on existing weapons. FIG. 38 shows the adoption of a typical bolt-action rifle by the addition of a hinged second pistol grip (10) and an adjustable palm swell (44) to one end of the lower forestock (8), with the other end attached to the buttstock (7). A connection rod or strut (34) provides intermediate support for the lower forestock (8) in the region of the first pistol grip. The rifle in FIG. 38 has been further enhanced by the addition of a detachable bi-pod stored in the lower forestock (8) and a support stand (26).

FIG. 39 shows that the present invention may even be applied to a lever-action rifle. The characteristic lever action necessitates an unrestricted path for the lever to travel through and thus an attachment point at the first pistol grip is not possible. Nevertheless, a connection rod or strut (34) may be attached to the first forestock (6) from the approximate mid point of-the lower forestock (8), with further attachment points at the buttstock and (via a new second pistol grip (10)) towards the fore-most portion of the first forestock (6).

It can be thus seen that the present invention of stock with a second lower forestock may be readily adapted for addition to a broad spectrum of weapons as well as being incorporated in stocks from the design stage.

It will be appreciated that the present invention need not be specifically limited to the attachment means described and that a variety of alternative known fastening means may be equally suitable.

Aspects of the present invention have been described by way of example only and it should be appreciated that modifications and additions may be made thereto without departing from the scope thereof as defined in the appended claims.

The invention claimed is:

1. A weapon stock, adapted to receive a firing assembly including a barrel and a receiver connected to the barrel, said weapon stock having a pistol grip interposed between a first forestock located towards a forward end and a buttstock located towards a rear end, such that in assembly with said firing assembly, said barrel is located adjacent to said first forestock towards said forward end, wherein said weapon stock further includes an elongated lower second forestock spatially separated below said first forestock for at least part of its length at a location substantially at or below the pistol grip and extending for a distance equal to or less than the distance between an end of the barrel distal to said receiver and an end of the buttstock distal to the barrel, said second forestock being attached to said first forestock at one attachment point and attached to either the buttstock or the pistol grip at another attachment point wherein at one or more said attachment point(s) the second forestock is not integrally formed with said stock, wherein at least one said attachment point is attached to said first forestock by one or more bracing elements extending downwardly from the first forestock and wherein at least one said bracing element is a handgrip, and wherein the second forestock extends below any pistol grip barrel, receiver, trigger and magazine (where fitted).

2. The weapon stock as claimed in claim 1 wherein said handgrip is a second pistol grip.

3. The weapon stock as claimed in claim 1, wherein said second fore stock includes attachment points located at one or both of said first pistol grip and said first forestock.

4. The weapon stock as claimed in claim 1, wherein said second forestock, attachment points include said first pistol grip, said buttstock and said first forestock.

5. The weapon stock as claimed in claim 1, wherein said attachment points of said second fore stock include the buttstock.

6. The weapon stock as claimed in claim 1, wherein said second forestock extends in a substantially parallel orientation with said barrel.

7. The weapon stock as claimed in claim 1, wherein said second forestock is inclined upwards towards said forward end.

8. The weapon stock as claimed in claim 1, wherein said second forestock is inclined downwards towards said forward end.

9. The weapon stock as claimed in claim 1, wherein said second forestock is discontinuous at one or more points between said buttstock and the distal end of the barrel.

10. The weapon stock as claimed in claim 1, wherein said second forestock is discontinuous at one or more points between said buttstock and said first pistol grip.

11. The weapon stock as claimed in claim 1, wherein said second forestock extends continuously from said first pistol grip towards the distal end of the barrel.

12. The weapon stock as claimed in claim 1, wherein said second forestock is discontinuous at one or more points between said first pistol grip and the distal end of the barrel.

13. The weapon stock as claimed in claim 1, wherein said buttstock at least partly defines a first opening configured to accept insertion of a user's shoulder and to rest the weapon thereupon to provide a shoulder sling.

14. The weapon stock as claimed in claim 1, wherein said second forestock at least partly defines a second opening configured to accept insertion of a user's shoulder and to rest the weapon thereupon to provide a shoulder sling.

15. The weapon stock as claimed in claim 1, wherein said second forestock is configured to accept one or more weapon accessories.

16. The weapon stock as claimed in claim 15, wherein said weapon accessories include hipods, extra handgrips, weapon magazines, bayonets, wire-cutters, communication devices, computational devices, batteries, target designator/acquisition devices and grenade launchers.

17. The weapon stock as claimed in claim 1, wherein said second forestock and/or said buttstock includes one or more support elements rotatably attached to the second forestock and/or buttstock and capable of being rotated laterally outwards from the stock to support the stock in a substantially horizontally-upright position when placed on a solid or semi-solid surface.

18. The weapon stock as claimed in claim 1, wherein said second forestock is releasably attached at a first end to said weapon stock, and pivotally attached to the weapon stock at a second end.

19. The weapon stock as claimed in claim 18, wherein said second forestock is capable of being rotated downwards about said second end to act as a weapon support.

20. The weapon stock as claimed in claim 19, wherein the second end is capable of engaging with a support element worn by the user.

21. The weapon stock as claimed in claim 1, wherein the second forestock located between said first pistol grip and the rear end of said buttstock is inclined upwards or downward towards said rear end.

22. The weapon stock as claimed in claim 1, further including a first forestock sling attachment element attached to said first forestock and extending at least partially over said barrel.

23. The weapon stock as claimed in any one of claims 1, 2, 3 and 6–11, wherein said attachment point of said second forestock to any of said buttstock, pistol grip, or first forestock is by at least one adjustable, releasable, pivotable, or slidable fastening.

24. A weapon stock, adapted to receive a firing assembly including a barrel and a receiver connected to the barrel, said weapon stock having a pistol grip interposed between a first forestock located towards a forward end and a buttstock located towards a rear end, such that in assembly with said firing assembly, said barrel is located adjacent to said first forestock towards said forward end, wherein said weapon stock further includes an elongated lower second forestock spatially separated below said first forestock for at least part of its length at a location substantially at or below the pistol grip and extending for a distance equal to or less than the distance between an end of the barrel distal to said receiver and an end of the buttstock distal to the barrel, said second forestock being attached to said first forestock at one attachment point and attached to either the butt-stock or the pistol grip at another attachment point wherein at one or more said attachment point(s) the second forestock is not integrally formed with said stocks, wherein at least one said attachment point is attached to said first forestock by one or more bracing elements extending downwardly from the first forestock and wherein at least one said bracing element is a handgrip, and wherein the second forestock lies in substantially the same plane as defined by the firing assembly, first forestock and the pistol grip, and extends below any pistol grip barrel, receiver, trigger and magazine (where fitted).

* * * * *